US007846633B2

(12) United States Patent
Nakamura et al.

(10) Patent No.: US 7,846,633 B2
(45) Date of Patent: Dec. 7, 2010

(54) TONER FOR DEVELOPING ELECTROSTATIC IMAGE, METHOD FOR PRODUCING THE SAME, DEVELOPER FOR DEVELOPING ELECTROSTATIC IMAGE, AND IMAGE FORMING METHOD

(75) Inventors: Masaki Nakamura, Minamiashigara (JP); Yasuhiro Arima, Minamiashigara (JP); Atsushi Sugawara, Minamiashigara (JP); Takeshi Tanabe, Minamiashigara (JP); Toshiyuki Yano, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 11/204,015

(22) Filed: Aug. 16, 2005

(65) Prior Publication Data

US 2006/0216628 A1 Sep. 28, 2006

(30) Foreign Application Priority Data

Mar. 22, 2005 (JP) ..... 2005-082132

(51) Int. Cl.
*G03G 9/093* (2006.01)

(52) U.S. Cl. ..... 430/110.2; 430/109.1

(58) Field of Classification Search ..... 430/109.1, 430/110.2

See application file for complete search history.

(56) References Cited

U.S. PATENT DOCUMENTS

| | | | | |
|---|---|---|---|---|
| 4,780,390 | A * | 10/1988 | Hosoi | 430/110.2 |
| 4,931,375 | A * | 6/1990 | Akimoto et al. | 430/109.3 |
| 6,326,117 | B1 * | 12/2001 | Ishihara | 430/110.2 |
| 6,413,691 | B2 | 7/2002 | Daimon et al. | |
| 6,531,542 | B1 * | 3/2003 | Morita et al. | 524/837 |
| 6,582,869 | B2 | 6/2003 | Daimon et al. | |
| 6,607,864 | B2 * | 8/2003 | Serizawa et al. | 430/123.52 |
| 7,291,436 | B2 * | 11/2007 | Nakamura et al. | 430/110.2 |
| 7,368,214 | B2 * | 5/2008 | Ishiyama et al. | 430/111.4 |
| 2002/0058190 | A1 | 5/2002 | Ishiyama et al. | |
| 2003/0124448 | A1 * | 7/2003 | Shinzo et al. | 430/109.4 |
| 2004/0091805 | A1 * | 5/2004 | Qian et al. | 430/109.1 |
| 2004/0091806 | A1 * | 5/2004 | Qian et al. | 430/109.31 |
| 2005/0069801 | A1 * | 3/2005 | Yamasaki et al. | 430/110.2 |
| 2005/0074685 | A1 * | 4/2005 | Kido et al. | 430/110.2 |
| 2005/0100809 | A1 * | 5/2005 | Fujino et al. | 430/110.2 |
| 2005/0159530 | A1 * | 7/2005 | Lee et al. | 524/458 |
| 2005/0175922 | A1 * | 8/2005 | Fujino et al. | 430/110.2 |
| 2005/0208414 | A1 * | 9/2005 | Nakamura et al. | 430/110.2 |
| 2006/0105263 | A1 * | 5/2006 | Moffat et al. | 430/110.2 |
| 2006/0165989 | A1 * | 7/2006 | Takikawa et al. | 428/402.2 |
| 2006/0166122 | A1 * | 7/2006 | Patel et al. | 430/110.2 |
| 2006/0210904 | A1 | 9/2006 | Ninomiya et al. | |
| 2006/0275679 | A1 | 12/2006 | Ishiyama et al. | |

FOREIGN PATENT DOCUMENTS

| | | | |
|---|---|---|---|
| EP | 0 628 883 | * | 12/1994 |
| JP | 60103356 | * | 6/1985 |
| JP | 02022668 | * | 1/1990 |
| JP | A 5-61242 | | 3/1993 |
| JP | A 5-181301 | | 7/1993 |
| JP | A-05-210330 | | 8/1993 |
| JP | A 6-342224 | | 12/1994 |
| JP | A-07-036213 | | 2/1995 |
| JP | A 8-220808 | | 8/1996 |
| JP | A-08-220932 | | 8/1996 |
| JP | A 8-254853 | | 10/1996 |
| JP | A 9-258480 | | 10/1997 |
| JP | B2 2750853 | | 2/1998 |
| JP | A-10-254173 | | 9/1998 |
| JP | A 2000-187358 | | 7/2000 |
| JP | A 2000-352839 | | 12/2000 |
| JP | A 2001-42568 | | 2/2001 |
| JP | A 2001-175025 | | 6/2001 |
| JP | A-2002-082473 | | 3/2002 |
| JP | A 2002-82485 | | 3/2002 |
| JP | A-2003-98722 | | 4/2003 |
| JP | A-2004-191927 | | 7/2004 |
| JP | A 2004-198658 | | 7/2004 |
| JP | A-2005-49858 | | 2/2005 |

OTHER PUBLICATIONS

Abstract of JP 60103356, Jun. 1985.*
Abstract of JP02022668, Jan. 1990.*
Office Action for U.S. Appl. No. 10/963,728; mailed Dec. 12, 2006.
Office Action for U.S. Appl. No. 11/143,462; mailed Jun. 29, 2007.
Information Offer Form with English Translation; submitted Nov. 7, 2009.
Information Offer Form with English Translation; Other document 1; submitted Nov. 7, 2009.
Jun. 29, 2010 Office Action issued in Japanese Application No. 2005-082132 (with translation).

* cited by examiner

*Primary Examiner*—Hoa V Le
(74) *Attorney, Agent, or Firm*—Oliff & Berridge, PLC

(57) ABSTRACT

A toner for developing an electrostatic image, the toner having a core-shell structure, wherein the toner comprises: a colorant; a binder resin; and a filler, and wherein the toner has a flow tester ½ effluent temperature of from 60 to 100° C., and a shell of the toner comprises a thermoplastic resin.

11 Claims, No Drawings

TONER FOR DEVELOPING ELECTROSTATIC IMAGE, METHOD FOR PRODUCING THE SAME, DEVELOPER FOR DEVELOPING ELECTROSTATIC IMAGE, AND IMAGE FORMING METHOD

BACKGROUND OF THE INVENTION

1. Field of the Invention

The present invention relates to a toner for developing an electrostatic image, a developer for developing an electrostatic image and an image forming method, and more particularly, it relates to a toner for developing an electrostatic image and a method for producing the same, a developer for developing an electrostatic image and an image forming method, which are used in an apparatus utilizing electrophotographic process used in a duplicator, a printer and facsimile machine, and particularly in a color duplicator.

2. Description of the Related Art

In recent years, the electrophotographic process is not only utilized in duplicators, but also widely applied to network printers for office use, printers for personal computers, and printers for on-demand publishing, owing to progress in equipments and enhancement of communication networks in the current information society. The printers are strongly demanded to have high image quality, high operation speed, high reliability, small size, light weight and energy saving capabilities, in both monochrome and color types.

In the electrophotographic process, an image is ordinarily formed in the following plural steps. A latent image is electrically formed on a photoreceptor utilizing a photoconductive substance by various means. The latent image is developed with a toner, and a toner image formed on the photoreceptors transferred to a transfer material, such as paper, through or not through an intermediate transfer material. Thereafter, the transferred image is fixed to the transfer material.

In general, as a contact fixing method, which has been ordinarily used as a method of fixing a toner, such a method using heat and pressure upon fixing has been utilized (hereinafter, referred to as a heat pressure method). In the heat pressure method, the surface of the fixing member and the toner image on the transfer material are in contact with each other under pressure, whereby fixation can be rapidly carried out with good thermal efficiency, and the method is particularly effective for a high-speed electrophotographic image forming apparatus.

According to the increasing demand for saving energy in recent years, toners have been investigated for low temperature fixing property to decrease electric power consumption upon fixing the toner, and among various investigations, some types of toners containing a crystalline resin as a binder resin have been reported. For example, JP-A-2002-082485 and JP-A-2000-352839 propose a toner containing a crystalline polyester resin. However, a toner using a crystalline resin as a binder resin has such a problem that the charge amount becomes low to provide insufficient developing capability.

JP-A-2001-42568 proposes a toner having such a structure that a crystalline resin is enclosed in a radical polymer, and the toner is excellent in charging property owing to the absence of a crystalline resin on the outermost surface of the toner. However, the toner has such a problem that the crystalline resin has a too low melt viscosity to bring about frequent occurrence of hot offset upon fixing.

It is considered as an effective measure that a crystalline resin is enclosed inside the toner to exert low temperature fixing property, and an electrically chargeable material is exposed on the outermost surface of the toner to exert charging property. However, it is the current situation that such a toner has not yet been obtained that the viscosity of the crystalline resin is adjusted into a suitable range, a surface satisfying developing property and transferring property is provided, and the total capability including developing property, transferring property and fixing property is satisfied.

Under the circumstances, for example, the following types of toners have been proposed. Such a toner is proposed, for example, in Japanese Patent No. 2,750,853 that contains mother particles having an effluent starting temperature of 110° C. or less and small particles coated and embedded on the surface of the mother particles. Such a toner is proposed, for example, in JP-A-5-181301 that contains a core material of a styrene-acrylate resin having a molecular weight of from 3,000 to 30,000 and a glass transition point of from 50 to 70° C. coated with a shell material of a styrene resin having a higher molecular weight and a higher glass transition point. Such a toner is proposed, for example, in JP-A-6-342224 that contains mother particles having resin fine particles for surface modification fixed thereto through mechanical impact. Such a toner is proposed, for example, in JP-A-8-254853 that contains a core material of a saturated fatty acid or a saturated alcohol having a melting point of from 40 to 100° C., which suspended in water and then encapsulated with resin fine particles. Such a toner is proposed, for example, in JP-A-9-258480 that contains low viscosity resin particles having accumulated on the surface thereof a thermally stable layer and a thermoplastic resin layer having a glass transition point of 65° C. or more. Such a toner is proposed, for example, in JP-A-2001-175025 that contains a toner containing a resin having a glass transition point of from 25 to 55° C. having attached on the surface thereof resin fine particles having a glass transition point of from 60 to 110° C. Such a toner is proposed, for example, in JP-A-8-220808 that uses a linear polyester resin having a softening point of from 90 to 120° C. and carnauba wax. Such a polymerized toner that has wax encompassed therein is proposed, for example, in JP-A-5-61242. Such a toner is proposed, for example, in JP-A-2004-198658 that contains a toner obtained by expanding and crosslinking an isocyanate group-containing prepolymer with an amine compound, on the surface of which fine particles are fixed.

However, these toners cannot be such a toner that is excellent in anti-offset property, storage stability and anti-filming property with satisfying the low temperature fixing property, which is being demanded in recent years. A capsule toner having a core-shell structure with a continuous shell layer is insufficient in low temperature fixing property, and that with a particulate shell layer as in JP-A-2002-082485 is low in viscoelasticity upon melting the toner and is insufficient in anti-offset property since it does not contain a releasing agent.

Furthermore, JP-A-2000-187358 proposes a toner having a filler contained therein for improvement in fixing property, but it is insufficient in low temperature fixing property due to a high softening temperature of the binder resin.

SUMMARY OF THE INVENTION

The invention has been developed in view of the aforementioned problems associated with the conventional art, and is to provide such a toner for developing an electrostatic image that has high reliability, is good in low temperature fixing property and thermal storage stability of the toner, and is excellent in anti-filming property to a latent image carrying member. The invention is also to provide a method for producing the toner, a developer for developing an electrostatic image, and an image forming method using the same.

The invention relates to the following embodiments (1) to (4).

(1) A toner for developing an electrostatic image, the toner having a core-shell structure, wherein the toner comprises: a colorant; a binder resin; and a filler, and wherein the toner has a flow tester ½ effluent temperature of from 60 to 100° C., and a shell of the toner comprises a thermoplastic resin.

(2) A method for producing the toner described in the item (1), the method containing steps of: aggregating binder resin particles of the binder resin in a dispersion liquid containing the binder resin particles, to form aggregated particles containing the binder resin, and attaching thermoplastic resin particles to a surface of the aggregated particles.

(3) A developer for developing an electrostatic image, containing: the toner for developing an electrostatic image described in the item (1); and a carrier.

(4) An image forming method containing steps of: forming an electrostatic latent image on a surface of a latent image carrying member; developing the electrostatic latent image formed on the surface of the latent image carrying member with a developer containing a toner, to form a toner image; transferring the toner image formed on the latent image carrying member to a surface of a transferring material; and fixing under heat the toner image transferred to the surface of the transferring material, wherein the toner described in the item (1) is used as the toner, or the developer described in the item (3) is used as the developer.

DETAILED DESCRIPTION OF THE INVENTION

The toner for developing an electrostatic image (hereinafter, sometimes simply referred to as a toner), the method for producing the same, the developer for developing an electrostatic image, and the image forming method using the same will be described in detail below.

(Toner for Developing Electrostatic Image)

The toner for developing an electrostatic image according to the invention is a core-shell toner containing at least a colorant, a binder resin and a filler. The toner has a flow tester ½ effluent temperature of from 60 to 100° C., and the shell of the toner contains a thermoplastic resin. The toner for developing an electrostatic image according to the invention has core particles (hereinafter, sometimes referred to as a core toner) encompassed with the shell (hereinafter, sometimes referred to as a shell layer), and the core toner contains a low softening point resin, whereby the low temperature fixing property is attained by the binder resin having a low softening temperature, and the powder characteristics necessary for a toner for developing an electrostatic image, i.e., the thermal storage stability and the anti-filming property to the surface of the latent image carrying member, are attained by the shell layer coated on the surface of the core toner containing the low softening point resin.

For attaining the low temperature fixing property, it is necessary that the toner of the invention has a lower softening temperature than the conventional toners and has a flow tester ½ effluent temperature of 100° C. or less. It is preferred that a crystalline resin having a melting point of 100° C. or less or an amorphous resin having a glass transition temperature of 60° C. or less is used as the binder resin of the core material, whereby the softening temperature of the toner of the invention.

(Measuring Method)

(Measurement of Flow Tester ½ Effluent Temperature)

The flow tester ½ effluent temperature can be measured by using a flow tester, CFT500, produced by Shimadzu Corp., with a die diameter of 0.5 mm, a die length of 0.5 mm, a pressure of 10 kgf and a temperature increasing rate of 3° C. per minute.

(Measurement of Particle System of Filler)

The particle system of the filler can be measured by using a laser diffraction particle size distribution measuring apparatus, LA-700, produced by Horiba, Ltd.

(Measurement of Average Molecular Weight of Resin)

The average molecular weight of the resin can be measured with gel permeation chromatography (GPC), HLC-8120 with a column, Super H3000, produced by Tosoh Corp.) under conditions of tetrahydrofuran (GPC Grade THF, produced by Wako Pure Chemical Industries, Ltd.) as a solvent, a column oven temperature of 40° C., a column flow rate of 1 mL per minute, a sample concentration of 0.5% and a sample injection amount of 0.1 mL. The measurement result is converted to the standard polystyrene (Standard Polystyrene, produced by Tosoh Corp.) basis based on the calibration line having been prepared to obtain the average molecular weight.

(Measurement of Melting Point of Crystalline Resin)

The melting point of the crystalline resin is measured with a differential scanning calorimeter (DSC60, produced by Shimadzu Corp.) under conditions of a sample amount of 8 g and a temperature increasing rate of 5° C. per minute. The melting point is obtained as a temperature corresponding to the melting peak recorded on the chart obtained as a result of the measurement. In the case where plural melting peaks appear, a temperature corresponding to the maximum peak is designated as a melting point (unit: ° C.).

(Measurement of Glass Transition Temperature of Resin)

The glass transition temperature of the resin is measured with a differential scanning calorimeter (DSC60, produced by Shimadzu Corp.) under conditions of a sample amount of 8 g and a temperature increasing rate of 5° C. per minute. The glass transition temperature (Tg) is obtained as a temperature corresponding to the shoulder on the low temperature side of the endothermic peak recorded on the chart obtained as a result of the measurement (unit: ° C.)

(Filler)

The toner of the invention contains a filler. The filler may be contained in one of the core or the shell of the toner, or may be contained in both the core and the shell, and it is preferred that the filler is contained in one of the core and the shell. The filler referred herein includes: organic resin particles that are resin particles being thermally infusible or having a glass transition temperature of 100° C. or more, which is substantially higher than the actual fixing temperature range; and/or inorganic particles. Examples of the filler that can be used in the invention include organic resin particles and inorganic particles, which may be used in combination.

The organic resin particles are not particularly limited, as far as they are thermally infusible or have a glass transition temperature of 100° C. or more, which is substantially higher than the actual fixing temperature range. Examples thereof include a homopolymer and a copolymer of such resins as a vinyl series, a styrene series, a (meth)acrylate series, an ester series, an amide series, a melamine series, an ether series and an epoxy series. Among these, an addition polymer resin, such as a vinyl series, a styrene series and a (meth)acrylate series, and a polycondensation polymer resin, such as an ester series, are preferably used. The term "(meth)acrylate" referred herein means both acrylate and methacrylate.

The production method of the organic resin particles is not particularly limited, and they can be produced by the conventional methods. For example, the addition polymer resin particles can be produced, for example, by suspension polymerization, emulsion polymerization or dispersion polymerization disclosed in "Jikken Kagaku Kouza 4th Edition No. 28, Kobunshi Gosei" (Lectures on Experimental Chemistry 4th Edition No. 28, Polymer Synthesis) (published by Maruzen Co., Ltd.), "Jikken Kagaku Kouza 4th Edition No. 29, Kobunshi Zairyo" (Lectures on Experimental Chemistry 4th Edition No. 29, Polymer Materials) (published by Maruzen Co., Ltd.), "Shin Kobunshi Jikken Gaku No. 4, Kobunshi no Gosei-Hannou (1), Fuka-kei Kobunshi no Gosei" (New Polymer Experimentation No. 4, Synthesis and Reaction of Polymers (1), Synthesis of Addition Series Polymers) (published by Kyoritsu Shuppan Co., Ltd.) and "Shin Kobunshi Jikken Gaku No. 4, Kobunshi no Gosei-Hannou (3), Kobunshi no Hanou to Bunkai" (New Polymer Experimentation No. 4, Synthesis and Reaction of Polymers (3), Reaction and Decomposition of Polymers) (published by Kyoritsu Shuppan Co., Ltd.). Fine particles having a core-shell structure produced by using seed polymerization can also be used. They can be produced by the polymerization granulation methods disclosed in JP-A-7-18003, JP-A-5-222267, JP-A-5-43608 and JP-A-7-228611.

As the production method of the polycondensation resin particles, the methods disclosed in JP-A-5-70600 and JP-A-7-248639 and the in-liquid drying method disclosed in JP-A-63-25664 may be preferably used.

The monomer constituting the addition polymer organic resin particles is not particularly limited, and, for example, the conventional monomers disclosed in "Kobunshi Data Handbook, Kiso-hen" (Polymer Data Handbook, Basic Part) (edited by The Society of Polymer Science, Japan, published by Baifukan Co., Ltd.) can be used solely or in combination of them. Those monomers disclosed in the aforementioned patent publications may also be used. Specific examples thereof include a vinyl monomer, such as an olefin compound, e.g., ethylene and propylene, a styrene monomer, such as styrene, α-methylstyrene, vinylnaphthalene, an alkyl-substituted styrene, e.g., 2-methylstyrene, 3-methylstyrene, 4-methylstyrene, 2-ethylstyrene, 3-ethylstyrene and 4-ethylstyrene, a halogen-substituted styrene, e.g., 2-chlorostyrene, 3-chlorstyrene and 4-chlorostyrene, and a fluorine-substituted styrene, e.g., 4-fluorostyrene and 2,5-difluorostyrene.

Examples of the (meth)acrylate monomer include (meth) acrylic acid, methyl (meth)acrylate, ethyl (meth)acrylate, n-propyl (meth)acrylate, n-butyl (meth)acrylate, n-pentyl (meth)acrylate, n-hexyl (meth)acrylate, n-heptyl (meth)acrylate, n-octyl (meth)acrylate, n-decyl (meth)acrylate, n-dodecyl (meth)acrylate, n-lauryl (meth)acrylate, n-tetradecyl (meth)acrylate, n-hexadecyl (meth)acrylate, n-octadecyl (meth)acrylate, isopropyl (meth)acrylate, isobutyl (meth) acrylate, t-butyl (meth)acrylate, isopentyl (meth)acrylate, amyl (meth)acrylate, neopentyl (meth)acrylate, isohexyl (meth)acrylate, isoheptyl (meth)acrylate, isooctyl (meth) acrylate, 2-ethylhexyl (meth)acrylate, phenyl (meth)acrylate, biphenyl (meth)acrylate, diphenylethyl (meth)acrylate, t-butylphenyl (meth)acrylate, terphenyl (meth)acrylate, cyclohexyl (meth)acrylate, t-butylcyclohexyl (meth)acrylate, dimethylaminoethyl (meth)acrylate, diethylaminoethyl (meth) acrylate, methoxyethyl (meth)acrylate, 2-hydroxyethyl (meth)acrylate, (meth)acrylonitrile and (meth)acrylamide.

Preferred examples of the vinyl monomer component having crosslinking property include a diene compound, such as isoprene and butadiene, an aromatic divinyl compound, such as divinylbenzene and divinylnaphthalene; a diacrylate compound bonded with an alkyl chain, such as ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and compounds obtained by substituting acrylate of these compounds with methacrylate; a diacrylate compound bonded with an alkyl chain containing an ether bond, such as diethylene glycol diacrylate, triethylene glycol diacryalte, tetraethylene glycol diacrylate, polyethylene glycol #400 diacrylate, polyethylene glycol #600 diacrylate, dipropylene glycol diacrylate, and compounds obtained by substituting acrylate of these compounds with methacrylate; a diacrylate compound bonded with a chain containing an aromatic group and an ether bond, such as polyoxyethylene(2)-2,2-bis(4-hydroxyphenyl)propane diacrylate, polyoxyethylene(4)-2,2-bis(4-hydroxyphenyl)propane diacrylate, and compounds obtained by substituting acrylate of these compounds with methacrylate; and a polyfunctional crosslinking agent, such as pentaerythritol triacrylate, trimethylolmethane triacrylate, trimethylolpropane triacrylate, tetramethylolmethane tetraacrylate, oligoester acrylate, and compounds obtained by substituting acrylate of these compounds with methacrylate.

Among these monomers, (meth)acrylic acid, 2-hydroxyethyl (meth)acrylate, acrylamide and the like having a carboxyl group, a hydroxyl group or an amide group have high solubility in an aqueous medium, and in the case where an aqueous medium is used as a continuous phase, there are cases where the monomer forms ultrafine particles by itself. In these cases, it is preferred that the kind of a dispersant or an emulsifier is appropriately selected, or the monomer is previously polymerized by itself or with another monomer to have a molecular weight of several thousands or less.

The monomer constituting the polycondensation polymer organic resin particles is not particularly limited, and a dibasic or tribasic or higher-basic carboxylic acid and a dihydric or trihydric or higher-hydric alcohol having been known in the art as disclosed in "Kobunshi Data Handbook, Kiso-hen" (Polymer Data Handbook, Basic Part) (edited by The Society of Polymer Science, Japan, published by Baifukan Co., Ltd.). Those monomers disclosed in the aforementioned patent publications may also be used. Specific examples thereof include a dibasic carboxylic acid, such as a dibasic acid, e.g., succinic acid, glutaric acid, adipic acid, suberic acid, azelaic acid, sebacic acid, phthalic acid, isophthalic acid, terephthalic acid, naphthalene-2,6-dicarboxylic acid, naphthalene-2,7-dicarboxylic acid, cyclohexanedicarboxylic acid, malonic acid and mesaconic acid, an anhydride and a lower alkyl ester of these dibasic acids, and an unsaturated fatty dicarboxylic acid, e.g., maleic acid, fumaric acid, itaconic acid and citraconic acid. Examples of a tribasic or higher-basic carboxylic acid include 1,2,4-benzenetricarboxylic acid, 1,2,5-benzenetricarboxylic acid, 1,2,4-naphthalenetricarboxylic acid, and an anhydride and a lower alkyl ester of these acids. These acids may be used solely or in combination of two or more of them.

Examples of the dihydric alcohol include bisphenol A, hydrogenated bisphenol A, an ethylene oxide and/or propylene oxide adduct of bisphenol A, 1,4-cyclohexanediol, 1,4-cyclohexanedimethanol, ethylene glycol, diethylene glycol, propylene glycol, dipropylene glycol, 1,3-butanediol, 1,4-butanediol, 1,5-pentanediol, 1,6-hexanediol and neopentyl glycol. Examples of the trihydric or higher-hydric alcohol include glycerin, trimethylolethane, trimethylolpropane and pentaerythritol. These alcohols may be used solely or in combination of two or more of them. In order to adjust the acid value or the hydroxyl group value, a monobasic acid, such as acetic acid and benzoic acid, and a monohydric alcohol, such as cyclohexanol and benzyl alcohol, may be used depending on necessity.

The organic resin particles preferably do not flow. In other words, the organic resin particles preferably have heat resistance. The organic resin particles are preferably organic crosslinked particles having a crosslinked structure, or in the case where they substantially do not have a crosslinked structure, they are preferably organic resin particles having a glass transition temperature Tg or a melting temperature Tm of 130° C. or more, more preferably 150° C. or more. Among these, the organic crosslinked particles are preferably used.

The organic resin particles preferably have a volume average particle diameter of from 1 to 300 nm, more preferably from 5 to 200 nm, and further preferably from 10 to 100 nm. The volume average particle diameter can be measured, for example, in the following manner. The particles to be measured are observed and photographed with a transmission electron microscope (TEM). 500 particles on the resulting micrograph are measured for particle diameter, and the average value thereof is calculated to obtain the volume average particle diameter.

The organic resin particles may be appropriately produced in the aforementioned production methods, or in alternative, commercially available products may be used. Examples of the commercially available products include those disclosed in "Biryushi Polymer no Shintenkai" (New Developments of Fine Particle Polymers) (edited by Toray Research Center, Inc.), and among these, Microgel Series, produced by Nippon Paint Co., Ltd., STADEX Series, produced by JSR Corp., and MR Series and MP Series, produced by Soken Chemical & Engineering Co., Ltd., are conveniently available.

The inorganic particles are preferably colorless or lightly colored inorganic particles having an average particle diameter of from 1 to 300 nm, and the volume average particle diameter thereof is preferably from 5 to 200 nm, and more preferably from 10 to 100 nm. The inorganic particles may be an inorganic oxide or a non-oxide, and specific examples thereof include silica, alumina, titanium oxide, barium titanate, magnesium titanate, calcium titanate, strontium titanate, zinc oxide, silica sand, clay, mica, wollastonite, diatom earth, cerium chloride, red iron oxide, chromium oxide, cerium oxide, antimony trioxide, magnesium oxide, zirconium oxide, silicon carbide and silicon nitride.

Examples of the synthesis method of the inorganic oxide particles include a method of hydrolyzing an chloride (such as silicon tetrachloride, titanium tetrachloride and aluminum tetrachloride) in a vapor phase, a method of synthesizing by a wet method, and a method of synthesizing by a high temperature melting method. Examples of the synthesis method of the non-oxide particles include a method of synthesizing by a chemical vapor phase method.

The inorganic particles are preferably titanium series particles and silica particles. In order to adjust the charging property, the particles may be subjected to a hydrophobic treatment with a hydrophobic agent.

Examples of the hydrophobic agent include a coupling agent (such as a silane coupling agent, a titanate coupling agent, an aluminate coupling agent and zirconium coupling agent) and a silicone oil. Among these, a silane coupling agent and a silicone oil are preferred. The hydrophobic agent may be used solely or in combination of two or more kinds of them.

As the silane coupling agent, all the types thereof, such as chlorosilane, alkoxysilane, silazane and a special silylating agent, may be used. Specific examples thereof include methyltrichlorosilane, dimethyldichlorosilane, trimethylchlorosilane, phenyltrichlorosilane, diphenyldichlorosilane, tetramethoxysilane, methyltrimethoxysilane, dimethyldimethoxysilane, ethyltrimethoxysilane, propyltrimethoxysilane, phenyltrimethoxysilane, diphenyldimethoxysilane, tetraethoxysilane, methyltriethoxysilane, dimethyldiethoxysilane, ethyltriethoxysilane, propyltriethoxysilane, phenyltriethoxysilane, diphenyltriethoxysilane, butyltrimethoxysilane, butyltriethoxysilane, isobutyltrimethoxysilane, hexyltrimethoxysilane, octyltrimethoxysilane, decyltrimethoxysilane, hexadecyltrimethoxysilane, trimethyltrimethoxysialzane, hexamethylsilazane, N,O-(bistrimethylsilyl)acetamide, N,N-bis(trimethylsilyl) urea, tert-butyldimethylchlorosilane, vinyltrichlorosilane, vinyltrimethoxysilane, vinyltriethoxysilane, vinyltriacetoxysilane, γ-methacryloxypropyltrimethoxysilane, β-(3,4-epoxycyclohexyl)ethyltrimethoxysilane, γ-glycidoxypropyltrimethoxysilane, γ-glycidoxypropyltriethoxysilane, γ-glycidoxypropylmethyldiethoxysilane, γ-mercaptopropyltrimethoxysilane, γ-chloropropyltrimethoxysilane, a fluorine silane compound obtained by substituting a part of hydrogen atoms of these compounds with fluorine atoms, such as trifluoropropyltrimethoxysilane, tridecafluorooctyltrimethoxysilane, heptadecafluorodecyltrimethoxysilane, heptadecafluorodecylmethyldimethoxysilane, tridecafluoro-1,1,2,2-tetrahydrooctyltriethoxysilane, 3,3,3-trifluoropropyltrimethoxysilane, heptadecafluoro-1,1,2,2-tetrahydrodecyltriethoxysilane and 3-heptafluoroisopropoxypropyltriethoxysilane, and an amino silane compound obtained by substituting a part of hydrogen atoms of these compounds with amino groups. The invention is not limited to these compounds.

Examples of the silicone oil include a dimethyl silicone oil, a methylhydrogen silicone oil, a methylphenyl silicone oil, acyclic dimethyl silicone oil, an epoxy-modified silicone oil, a carboxyl-modified silicone oil, a carbinol-modified silicone oil, a methacryl-modified silicone oil, a mercapto-modified silicone oil, a polyether-modified silicone oil, a methylstyryl-modified silicone oil, an alkyl-modified silicone oil, an amino-modified silicone oil and a fluorine-modified silicone oil. The invention is not limited to these silicon oils.

Upon using particles having been subjected to the hydrophobic treatment, the charge amount under high humidity conditions can be improved, and as a result, the environment stability of charge can be favorably improved.

The hydrophobic treatment of the particles can be carried out in the following conventional manners, i.e., the treating agent mixed and diluted with a solvent, such as tetrahydrofuran, toluene, ethyl acetate, methyl ethyl ketone and acetone, is added dropwise or sprayed to the particles, which are forcedly agitated with a blender, and the particles are washed and filtered depending on necessity, followed by crushing the dried aggregated product in a mortar or a blender; the fine particles are immersed in a solution of the treating agent dissolved in a solvent, followed by drying; the treating agent solution is added dropwise to slurry of the fine particles obtained by dispersing in water, and then the fine particles are precipitated, dried under heat and then crushed; and the treating agent is directly sprayed onto fine particles. The attached amount of the treating agent to the particles is preferably from 0.01 to 50% by weight, and more preferably from 0.1 to 25% by weight, based on the amount of the particles. The attached amount can be changed by increasing the mixing amount of the treating agent upon treating or by changing the number of washing steps after the treatment. The attached amount of the treating agent can be quantitatively determined by XPS or elemental analysis. In the case where the attached amount of the treatment agent is too small, there are cases where the charging property is lowered under high humidity conditions, and in the case where the treating amount is too large, there are cases where the charging property under high humidity conditions becomes excessive, and the released treating agent deteriorates the powder flowability of the developer.

(Shell)

The shell of the toner of the invention contains a thermoplastic resin. The thermoplastic resin used herein is a resin having a glass transition temperature equal to or higher than room temperature and 100° C. or less.

The material for the shell may contain organic resin particles and/or inorganic particles that are thermally infusible or have a glass transition temperature of 100° C. or more, which is substantially higher than the actual fixing temperature range.

In the case where the shell contains the filler, the shell has such a structure that the thermoplastic resin is present in voids among the filler particles to cover the core component with the thermoplastic resin. Such a structure is preferred that the filler particles are present in a larger amount on the outermost surface of the toner, and the thermoplastic resin is present in a larger amount on the surface of the core. The filler preferably has a particle diameter of from 10 to 300 nm, and more preferably from 10 to 150 nm. In the case where the filler has a particle diameter in the aforementioned range, the filler can uniformly cover the surface of the toner, and the toner surface has appropriate unevenness to exert sufficient effect of a fluidizing agent, whereby the toner favorably has good flowability to facilitate handling upon forming the shell.

The amount of the shell is preferably from 5 to 50% by weight based on the core toner. In the case where the amount of the shell is in the aforementioned range, the fixing temperature is not increased, and the thermal storage stability is improved.

(Filler Amount in Shell)

In the case where the shell of the toner of the invention contains the filler, the amount of the filler in the shell is not particularly limited. In the case where the amount of the filler in the shell is 30% by weight or more, even when the interior of the toner is softened by applying a temperature exceeding 50° C. to the toner upon storing or using in an apparatus, the shell layer maintains the hardness of the surface of the toner, whereby the powder characteristics necessary for a toner for developing an electrostatic image, such as thermal storage stability and anti-filming property to a latent image carrying member, can be ensured. It is considered that the thermoplastic resin used in the shell covers the low softening point component in the core to prevent the low softening point component from migrating to the toner surface, and simultaneously strengthens binding among the filler particles and binding between the filler and the core toner, whereby the filler is prevented from being released from the toner surface to improve the reliability.

(Thermoplastic Resin as Material for Shell)

The thermoplastic resin that can be used in the shell in the invention is preferably an amorphous resin having a glass transition temperature of 55° C. or more, and the glass transition temperature is more preferably 60° C. or more in consideration of temperature increase in a high-speed apparatus and margin upon storing for a prolonged period of time. The molecular weight of the amorphous resin is not particularly limited, and in general, the weight average molecular weight is preferably 5,000 or more. In the case where the molecular weight of the resin is too small, there are cases where the toner is broken upon agitation in a developing device, and the fixing latitude is deteriorated. The amorphous resin referred herein means such a resin that has no endothermic peak ascribed to crystal melting in a thermal analysis using a differential scanning calorimeter (DSC), and is in a solid state at ordinary temperature and is elasticized at a temperature exceeding the glass transition temperature.

Examples of the amorphous resin include a polyamide resin, a polycarbonate resin, a polyether resin, a polyacrylonitrile resin, a polyarylate resin, a polyester resin and a styrene-acrylate resin. Among these, a polyester resin can be synthesized by the conventionally known method, such as the ester exchanging method and the polycondensation method, using a combination of a dicarboxylic acid component and a diol component, which may be appropriately selected.

(Core)

The core of the toner of the invention contains a binder resin. The binder resin used in the core is preferably a crystalline resin having a melting point of 100° C. or less or an amorphous resin having a glass transition temperature of 60° C. or less. The core may contain the filler, which is the same as that used in the shell.

(Amount of Filler in Core)

In the case where the core of the toner of the invention contains the filler, the amount of the filler in the core is not particularly limited. In the case where the amount of the filler in the core is 10% by weight or more, even when the toner suffers a temperature exceeding 50° C. upon storing or using in an apparatus, the core can be suppressed from suffering excessive softening by the structural viscosity of the particles dispersed in the core. Accordingly, the powder characteristics necessary for a toner for developing an electrostatic image, such as thermal storage stability and anti-filming property to a latent image carrying member, can be ensured.

In the case where the amount of the filler in the core is 40% by weight or less, it is preferred since the thermal fusibility of the core is maintained, whereby the fixing temperature is prevented from increasing, and good image smoothness can be obtained.

(Binder Resin)

In order that the toner has such melt characteristics that the flow tester ½ effluent temperature is 100° C. or less, the binder resin that can be used in the invention is preferably a crystalline resin and/or an amorphous resin, and more preferably a crystalline resin.

The binder resin that can be used in the core part in the invention will be described below.

(Crystalline Resin as Binder Resin)

In order that the toner has such melt characteristics that the flow tester ½ effluent temperature is 100° C. or less in the invention, a crystalline resin is preferably used as the binder resin. The crystalline resin referred in the invention is a resin having a melting point, and more specifically a resin having an endothermic peak in thermal analysis measurement using a differential scanning calorimeter (DSC). The crystalline resin preferably has a melting point of 40° C. or more, and particularly preferably 60° C. or more, and is preferably 100° C. or less, and particularly preferably 90° C. or less. In order to attain the low temperature fixing property, the crystalline resin preferably has a melting point of from 60 to 95° C.

In the case where the crystalline resin has a melting point in the aforementioned range, the toner favorably attains the low temperature fixing property without occurrence of blocking upon storing or using the toner.

In the case where the crystalline resin has a melting point of from 60 to 95° C., the glass transition point is below room temperature, the melt viscosity of the crystalline resin tends to become too small in comparison to an amorphous resin having a glass transition temperature of from 50 to 70° C. having the same molecular weight.

Therefore, it is preferred that such a crystalline resin is used that has a higher molecular weight than the conventional amorphous resin, or in alternative, the melt viscosity of the toner is increased by ion crosslinking (such as ion crosslinking with a crystalline resin molecular chain and a metallic ion aggregating agent formed during the aggregation and integration method). Hot offset upon fixing can be prevented from occurring by using these measures. The crystalline resin preferably has a melt viscosity of 50 Pa·s or more, and more preferably 100 Pa·s or more. The upper limit of the melt viscosity is preferably 100,000 Pa·s or less in consideration of the fixing temperature.

The melting point of the crystalline resin can be obtained as a melting peak temperature in the input compensation differential scanning calorimetry according to JIS K7121. In the case where there are plural melting peaks, the maximum melting peak is designated as that shows the melting point.

The molecular weight of the crystalline resin is not particularly limited, and in general, the weight average molecular weight thereof is preferably 8,000 or more, and more preferably 10,000 or more, and is preferably 100,000 or less, and more preferably 70,000 or less. In the case where the molecular weight of the crystalline resin is in the aforementioned range, a fixed image obtained has a sufficient strength, the toner does not suffer crushing upon agitation in a developing device, the fixing temperature is not increased.

A polyester resin is preferred as the crystalline resin.

Specific examples of the polyester resin include poly-1,2-cyclopropenedimethylene isophthalate, polydecamethylene adipate, polydecamethylene azelate, polydecamethylene oxalate, polydecamethylene sebacate, polydecamethylene succinate, polyeicosamethylene malonate, polyethylene-p-(carbophenoxy) butyrate, polyethylene-p-(carbophenoxy) undecanoate, polyethylene-p-phenylene diacetate, polyethylene sebacate, polyethylene succinate, polyhexamethylene carbonate, polyhexamethylene-p-(carbophenoxy) undecanoate, polyhexamethylene oxalate, polyhexamethylene sebacate, polyhexamethylene suberate, polyhexamethylene succinate, poly-4,4-isopropylidenediphenylene adipate and poly-4,4-isopropylidenediphenylene malonate.

Specific examples of the polyester resin further include trans-poly-4,4-isopropylidenediphenylene-1-methylcyclopropane dicarboxylate, polynonamethylene azelate, polynonamethylene terephthalate, polyoctamethylene dodecanedioate, polypentamethylene terephthalate, trans-poly-m-phenylenecyclopropane dicarboxylate, cis-poly-m-phenylenecyclopropane dicarboxylate, polytetramethylene carbonate, polytetramethylene-p-phenylene diacetate, polytetramethylene sebacate, polytrimethylene dodecanedioate, polytrimethylene octadecanedioate, polytrimethylene oxalate, polytrimethylene undecanedioate, poly-p-xylene adipate, poly-p-xylene azelate, poly-p-xylene sebacate, polydiethylene glycol terephthalate, cis-poly-1,4-(2-butene) sebacate and polycaprolactone. A copolymer of plural ester monomers used in these polymers and a copolymer of the ester monomer with another copolymerizable monomer may also be used.

(Amorphous Resin as Binder Resin)

In order that the toner has such melt characteristics that the flow tester ½ effluent temperature is 100° C. or less in the invention, an amorphous resin having a glass transition temperature of 60° C. or less is preferably used as the binder resin. The molecular weight of the amorphous resin is not particularly limited, and the weight average molecular weight thereof is preferably from 5,000 to 100,000. In the case where the resin has a molecular weight in the aforementioned range, a fixed image obtained has a sufficient strength, the toner does not suffer crushing upon agitation in a developing device, the fixing temperature is not increased.

Examples of the amorphous resin include a polyamide resin, a polycarbonate resin, a polyether resin, a polyacrylonitrile resin, a polyarylate resin, a polyester resin and a styrene-acrylate resin. Among these, a polyester resin can be synthesized by the conventionally known method, such as the ester exchanging method and the polycondensation method, using a combination of a dicarboxylic acid component and a diol component, which may be appropriately selected.

Examples of the dicarboxylic acid component include terephthalic acid, isophthalic acid, cyclohexanedicarboxylic acid, naphthalene dicarboxylic acid, such as naphthalene-2,6-dicarboxylic acid and naphthalene-2,7-dicarboxylic acid, and biphenyldicarboxylic acid. Examples thereof further include a dibasic acid, such as succinic acid, glutaric acid, adipic acid, suberic acid, azelaic acid, sebacic acid, phthalic acid, malonic acid and mesaconic acid, an anhydride and a lower alkyl ester of these dibasic acids, and an unsaturated fatty dicarboxylic acid, such as maleic acid, fumaric acid, itaconic acid and citraconic acid. A tribasic or higher-basic carboxylic acid, such as 1,2,4-benzenetricarboxylic acid, 1,2,5-benzenetricarboxylic acid, 1,2,4-naphthalenetricarboxylic acid, and an anhydride and a lower alkyl ester of these acids can also be used in combination. In order to adjust the acid value or the hydroxyl group value, a monobasic acid, such as acetic acid and benzoic acid, may be used depending on necessity.

Examples of the diol component include ethylene glycol, propylene glycol, neopentyl glycol, cyclohexanedimethanol, an ethylene oxide adduct of bisphenol A and/a propylene oxide adduct of bisphenol A. Examples thereof further include bisphenol A, hydrogenated bisphenol A, 1,4-cyclohexanediol, 1,4-cyclohexanedimethanol, diethylene glycol, dipropylene glycol, 1,3-butanediol, 1,4-butanediol, 1,5-pentanediol, 1,6-hexanediol and neopentyl glycol. A trihydric or higher-hydric alcohol, such as glycerin, trimethylolethane, trimethylolpropane and pentaerythritol may be used only in a slight amount. These alcohols may be used solely or in combination of two or more of them. A monohydric alcohol, such as cyclohexanol and benzyl alcohol, may be used depending on necessity.

(Colorant)

The toner of the invention contains a colorant. The colorant is not particularly limited, and colorants having been known in the art can be used after appropriately selecting depending on purposes. Specific examples thereof include carbon black, lamp black, aniline blue, ultramarine blue, calco oil blue, methylene blue chloride, copper phthalocyanine blue, quinoline yellow, chrome yellow, Du Pont oil red, Orient oil red, rose bengal, malachite green oxalate, a nigrosin dye, C.I. Pigment Red 48:1, C.I. Pigment Red 57:1, C.I. Pigment Red 81:1, C.I. Pigment Red 122, C.I. Pigment Yellow 97, C.I. Pigment Yellow 12, C.I. Pigment Yellow 17, C.I. Pigment Blue 15:1 and C.I. Pigment Blue 15:3.

In general, the content of the colorant is preferably 1 part by weight or more, and is preferably 30 parts by weight or less, and more preferably 20 parts by weight or less, per 100 part by weight of the binder resin. In the case where the content of the colorant is in the aforementioned range, sufficient coloration can be obtained with a small amount of the toner, a suitable melt viscosity is obtained, and the fixing temperature is not increased. The content of the colorant is preferably as large as possible as far as the smoothness of the surface of the image obtained after fixing the toner is not impaired. By increasing the content of the colorant, the thickness of the image can be reduced for obtaining a certain density of the image, and thus it is effective for preventing offset from occurring. The toner of the invention can be prepared as a yellow toner, a magenta toner, a cyan toner, a black toner or the like corresponding to the species of the colorant used.

(Magnetic Powder)

In the case where the toner of the invention is used as a magnetic toner, magnetic powder may be contained in the binder resin. The magnetic powder herein is a substance that is magnetized in a magnetic field. Specific examples thereof include ferromagnetic metallic powder, such as iron, cobalt and nickel, and compound ferromagnetic powder, such as ferrite and magnetite.

(External Additive)

In order to improve the durability and the powder flowability of the toner of the invention, the toner is preferably externally added with fine particles as an external additive. Preferred examples of the fine particles to be externally added include the organic resin powder particles and the inorganic particles used as the filler described hereinabove.

(Other Additives)

In the toner of the invention, various kinds of known additives may be used in combination. The known additives are not particularly limited and can be appropriately selected depending on purposes, and examples thereof include a releasing agent and a charge controlling agent.

Examples of the releasing agent include wax, such as paraffin wax, e.g., low molecular weight polypropylene and low molecular weight polyethylene, a silicone resin, a rosin compound, rice wax and carnauba wax. The releasing agent such as the wax preferably has a melting point of from 40 to 150° C., and more preferably from 60 to 110° C. The using amount of the wax is not particularly limited, and it is generally used in an amount of 0.1% by weight or more, and preferably 0.5% by weight or more, in the toner for developing an electrostatic image. The amount of the releasing agent is preferably 20% by weight or less. In the case where the amount of the wax is in the aforementioned range, releasing failure is prevented from occurring upon oilless fixing, the flowability of the toner is improved, and the color image quality and the reliability are improved.

Examples of the charge controlling agent include a metallic salt of salicylic acid, a metal-containing azo compound, nigrosin and a quaternary ammonium salt. The charge controlling agent is used for improving the charging property of the toner for developing an electrostatic image.

(Production Method of Toner for Developing Electrostatic Image)

The production method of the toner for developing an electrostatic image of the invention contains an aggregating step of aggregating binder resin particles of the binder resin in a dispersion liquid containing the binder resin particles, to form aggregated particles containing the binder resin, and an attaching step of attaching thermoplastic resin particles to a surface of the aggregated particles. In the case where the filler is added to the core, it is preferred that the filler is added in the aggregating step by the known method, and in the case where the filler is added to the shell, it is preferred that the filler is added in the attaching step by the known method.

It is important in the toner for developing an electrostatic image of the invention that the low softening point resin component used for attaining low temperature fixing property is prevented from being exposed to the surface of the toner. In the case where the low softening point resin component is exposed to the surface of the toner or is present on the surface due to dissolution with the thermoplastic resin, the toner powder suffers blocking at a temperature of from room temperature to the temperature inside the apparatus, which is about 50° C. or higher. In this case, the powder characteristics are insufficient since the toner causes filming on the latent image carrying member due to friction with a cleaning blade and pressure applied by a charging roll. For example, in the shell forming method in the presence of a large amount of solvent as disclosed in JP-A-2004-198658, the low softening point resin component dissolved in the solvent are incorporated in the shell in a large amount to expose the low softening point resin component to the surface of the toner, whereby it fails to avoid sufficiently the aforementioned problem.

As a shell forming method in the production method of the toner for preventing the low softening point resin component from being exposed, JP-A-6-342224 proposes a method of mechanically fixing fine particles. However, in consideration of productivity, such methods are preferred that a shell is formed in water in the aggregation and integration method, and then fine particles are added thereto (as disclosed in JP-A-11-143125), and a core toner is produced, and then a shell is formed by adding fine particles.

In the production method of the toner having a core-shell structure of the invention, the wet production method of a toner having been known in the art can be employed. Examples of the wet production method of a toner include the aggregation and integration method, in which a binder resin particle dispersion liquid and a colorant particle dispersion liquid are mixed and heated to a temperature higher than the glass transition point or the melting point of the binder resin, whereby the aggregated particles are fused and integrated to form toner particles (as disclosed, for example, in JP-A-2002-82473), the in-liquid drying method (as disclosed, for example, in JP-A-63-25664), the method, in which a molten toner is divided into fine particles by agitating with shearing force in an insoluble liquid, and a method, in which a dispersion liquid of a binder resin and a colorant dispersed in a solvent is divided into fine particles by jet-spraying. Among these methods, the aggregation and integration method is preferred. Other examples of the production method of a toner that can be used herein include a dry production method of a toner, such as the kneading and pulverizing method, in which a binder resin is melted and kneaded with a pigment, a charge controlling agent and a releasing agent, such as wax, and the mixture is cooled and pulverized, followed by classifying, and the kneading and freeze-pulverizing method.

In the aggregation and integration method, a binder resin particle dispersion liquid and a colorant dispersion liquid are mixed to prepare a dispersion liquid containing the binder resin particles and the colorant, and the dispersion liquid thus obtained is heated to a temperature higher than the glass transition point or the melting point of the binder resin, whereby the aggregated particles are fused and integrated to form toner particles. The binder resin particle dispersion liquid can be produced, for example, by the emulsion polymerization method and the forced emulsifying method. The colorant dispersion liquid can be prepared by dispersing a colorant by using an ionic surfactant having a polarity opposite to the ionic surfactant contained in the binder resin particle dispersion liquid. The binder resin particle dispersion liquid and the colorant dispersion liquid are mixed to cause hetero-aggregation to form aggregated particles having a diameter corresponding to the toner diameter, and then the system is heated to a temperature higher than the glass transition point or the melting point of the binder resin, whereby the aggregated particles are fused and integrated to form toner particles.

The operation of causing hetero-aggregation may be carried out by mixing the binder resin particle dispersion liquid and the colorant dispersion liquid with a releasing agent dispersion liquid at once, but other operations may be employed. For example, the following procedures may be employed. The balance of the amount of the ionic surfactant of the polarity is deviated in advance (for example, ionically neutralizing with an inorganic metallic salt, such as calcium nitrate, a tetravalent aluminum salt, such as polyaluminum chloride and polyaluminum hydroxide, or polymers thereof), and mother aggregated particles of the first step are formed at a temperature lower than the glass transition point. After stabilizing the mother aggregated particles of the first step, such a particle dispersion liquid that is selected in polarity and amount to compensate the deviation of the ionic balance is added as the second step, and then depending on necessity, the system is slightly heated to a temperature lower than the glass transition point or the melting point of the resin contained in the mother particles or the added particles, so as to stabilize the particles at a higher temperature. Thereafter, the system is heated to a temperature higher than the glass transition point or the melting point, whereby the mother aggregated particles are fused with the particles added in the second step attached to the surface thereof, so as to obtain toner particles having a core-shell structure. The stepwise operation for aggregation may be carried out in plural times.

In the production method of the toner having a core-shell structure of the invention, the shell layer can be formed on a core toner produced by various production methods by utilizing the aggregation and integration method. The method will be described in detail below.

After producing a core toner, a core dispersion liquid is prepared, and a particle dispersion liquid of a material for forming a shell is mixed with the resulting core dispersion liquid, whereby the shell is formed on the surface of the core. Upon forming the shell, the mixed liquid is preferably heated to a temperature around the glass transition temperature of the resin for forming the shell. Examples of the material for forming the shell include those having been described hereinabove.

In the case where the toner having a core-shell structure is produced, before the aggregating and integrating step, it is possible that a releasing agent dispersion liquid is also added in addition to the binder resin particle dispersion liquid and the colorant dispersion liquid, and then the binder resin particles, the colorant and the releasing agent are aggregated and integrated. The releasing agent dispersion liquid can be prepared by dispersing the releasing agent by using a surfactant in an emulsifying apparatus, such as a homogenizer.

After producing the toner dispersion liquid in the aforementioned methods, the toner particles are washed and dried to obtain a toner. In consideration of the charging property of the toner, it is preferred that the toner is sufficiently washed with ion exchanged water by the substitution washing method. The method of solid-liquid separation after washing is not particularly limited, and in consideration of productivity, suction filtration, pressure filtration and the like are preferably employed. The method of drying is also not particularly limited, and in consideration of productivity, freeze drying, air flow drying, fluidized drying, vibration fluidized drying and the like are preferably employed.

A surfactant is used in the production method of a toner according to the invention used for emulsion polymerization of the binder resin particles, dispersion of the colorant, addition and dispersion of the binder resin particles, dispersion of the releasing agent, and aggregation and stabilization of them. Examples of the surfactant include an anionic surfactant, such as a sulfate salt series, a sulfonate salt series, a phosphate salt series and a soap series, and a cationic surfactant, such as an amine salt series and a quaternary ammonium salt series. It is effective to use in combination a nonionic surfactant, such as a polyethylene glycol series, an alkylphenol ethylene oxide series and a polyhydric alcohol series. The means for dispersing with the surfactant may be the ordinary measures, such as a rotation shearing homogenizer and a mill using a medium, such as a ball mill, a sand mill and a Dinor mill.

The volume average particle diameter of the toner of the invention is not particularly limited and is generally from 3 to 20 μm, and preferably from 4 to 15 μm. In the case where the particle diameter is in the aforementioned range, noise on images can be suppressed, and the powder flowability, the developing property and the transferring property of the toner can be improved. The particle diameter distribution of the toner is generally 1.35 or less, and preferably 1.30 or less. In the case where the particle diameter distribution is in the aforementioned range, good transferring property can be obtained, and fogging on the background is prevented from occurring.

(Developer for Developing Electrostatic Image)

The developer for developing an electrostatic image of the invention can be produced by combining the toner of the invention with a carrier.

The carrier is not particularly limited, and examples thereof include magnetic material particles, such as iron powder, ferrite, iron oxide powder and nickel; a resin coated carrier containing magnetic material particle as a core material having coated on the surface thereof a resin, such as a styrene resin, a vinyl resin, an ethylene resin, a rosin resin, a polyester resin and a melamine resin, or wax, such as stearic acid; and a magnetic material dispersed carrier formed by dispersing magnetic material particles in a binder resin. Among these, the resin coated carrier is particularly preferred since it can be controlled in the charging property of the toner and the overall resistance of the carrier by changing the layer structure of the coated resin.

The mixing ratio of the toner of the invention and the carrier in the developer for developing an electrostatic image of the invention is generally from 2 to 10 parts by weight of the toner per 100 parts by weight of the carrier. The production method of the developer is not particularly limited, and examples thereof include a method of mixing them in a V blender.

(Image Forming Method)

The image forming method of the invention contains a latent image forming step of forming an electrostatic latent image on a surface of a latent image carrying member, a developing step of developing the electrostatic latent image formed on the surface of the latent image carrying member with a developer containing a toner, to form a toner image, a transferring step of transferring the toner image formed on the latent image carrying member to a surface of a transferring material, and a fixing step of fixing under heat the toner image transferred to the surface of the transferring material, in which the toner of the invention is used as the toner, or the developer of the invention is used as the developer.

The developer may be either the one-component system or the two-component system. The steps having been known in the conventional image forming methods may be employed as the aforementioned steps. The image forming method of the invention may contain a step other than the aforementioned steps.

As the latent image carrying member, for example, an electrophotographic photoreceptor and a dielectric recording material may be used.

In the case where an electrophotographic photoreceptor is used, the surface of the electrophotographic photoreceptor is uniformly charged with a corotron charging device or a contact charging device and then imagewise exposed to form an electrostatic latent image (latent image forming step). Subsequently, the surface of the photoreceptor is made in contact with or is made closely to a developer roll having a developer layer on the surface thereof to attach the toner particles to the electrostatic latent image, so as to form a toner image on the electrophotographic photoreceptor (developing step). The toner image thus formed is transferred to a transfer material, such as paper, by utilizing a corotron charging device or the like (transferring step). The toner image thus transferred to the surface of the transfer material is thermally fixed by a fixing device to form finally a fixed toner image.

Upon thermally fixing by a fixing device, a releasing agent is generally fed to a fixing member of the fixing device for preventing offset from occurring.

Since the developer of the invention (or the toner of the invention) is used in the image forming method of the invention, the fixing step can be effected at a low temperature, and the toner can maintain an appropriate frictional charge amount. Accordingly, the image forming method of the invention is excellent in energy saving property upon forming an image, and can form an image in good conditions while preventing the toner from being scattered.

(Low Temperature Fixing Property)

A non-fixed image is formed by using a commercially available electrophotographic duplicator (Docu Centre Color 500, produced by Fuji Xerox Co., Ltd.) using the toner or the developer of the invention, and then the fixing property and the hot offset property of the image can be evaluated by using an external fixing device (a free belt nip fuser of Docu Centre Color 400) at a fixing temperature increasing stepwise within a range of from 70 to 220° C. The low temperature fixing property is evaluated in such a manner that after fixing a non-fixed solid image (25 mm×25 mm), the image is folded by using a prescribed weight, and the temperature, at which the dropout width of the image at the folded part becomes 0.5 mm, is designated as the lowest fixing temperature, which is used as an index of the low temperature fixing property. More specifically, the lowest fixing temperature is preferably 120° C. or less.

(Anti-filming Property)

In the toner thus developed on the latent image carrying member, the toner remaining on the latent image carrying member as a non-transferred toner is recovered with a cleaning blade or a cleaning roll. At this time, the toner is cleaned while pressing on the surface of the latent image carrying member, and therefore, the toner having the low softening point component exposed to the surface thereof is filmed on the surface of the latent image carrying member upon application of heat, so as to cause finally image defects. The toner of the invention has the low softening point component encompassed with the shell layer. Furthermore, in the case where the core contains a filler, the toner surface maintains hardness with the filler, which is substantially not softened, or alternatively, in the case where the shell contains a filler, the core is suppressed from suffering excessive softening by the structural viscosity of the particles dispersed in the core to prevent collapse of the core. As a result, the cleaning property is improved to prevent filming from occurring, and thus excellent image reliability can be provided.

EXAMPLE

The invention will be described in more detail below with reference to the example, but the invention is not construed as being limited to the examples.

(Production Example of Crosslinked Particle Aqueous Dispersion Liquid (F1) as Filler Component)

334 parts by weight of ion exchanged water is placed in a reaction vessel equipped with a stirrer having plural stirring blades, a reflux condenser, a thermometer and a nitrogen introducing pipe, and the interior of the reaction vessel is sufficiently replaced with nitrogen. A mixture of 16 parts by weight of sodium dodecylbenzenesulfonate, 70 parts by weight of styrene monomer, 15 parts by weight of acrylic acid monomer and 20 parts by weight of divinylbenzene monomer and 1.5 parts by weight of sodium persulfate are added to the reaction vessel and sufficiently stirred to obtain a mixed solution (having a resin concentration of 30%). The mixed solution is stirred at about 250 rpm and reacted at about 80° C. for about 5 hours. The resulting crosslinked particles P1 are substantially spherical particles having a volume average particle diameter of 0.065 μm. The average particle diameter of the particles is measured with Microtrack UPA 9340 produced by Nikkiso Co., Ltd.

(Production Example of Silica Aqueous Dispersion Liquid (F2) as Filler Component)

| | |
|---|---|
| Surface hydrophobic treated silica (RX 50, produced by Nippon Aerosil Co., Ltd., diameter: 40 nm) | 100 parts by weight |
| Anionic surfactant (Neogen RK, produced by Daiichi Kogyo Seiyaku Co., Ltd.) | 5 parts by weight |
| Ion exchanged water | 895 parts by weight |

The aforementioned anionic surfactant is mixed with 895 parts by weight of ion exchanged water, the aforementioned silica particles are gradually added to the resulting aqueous solution to obtain a silica dispersion liquid (F2) (having a filler solid concentration of 10%).

(Preparation of Amorphous Styrene-Acrylate Polymer Dispersion Liquid (SR1) as Thermoplastic Resin Component of Shell)

| | |
|---|---|
| Styrene | 370 parts by weight |
| n-Butyl acrylate | 30 parts by weight |
| Acrylic acid | 4 parts by weight |
| Dodecanethiol | 24 parts by weight |
| Carbon tetrabromide | 4 parts by weight |

A solution obtained by mixing and dissolving the aforementioned materials is dispersed and emulsified in a solution obtained by dissolving 6 parts by weight of a nonionic surfactant (Nonipol 400, produced by Sanyo Chemical Industries, Ltd.) and 10 parts by weight of an anionic surfactant (Neogen SC produced by Diich Kogyo Seiyaku Co., Ltd.) in 560 parts by weight of ion exchanged water in a flask, to which 50 parts by weight of ion exchanged water having 4 parts by weight of ammonium persulfate dissolved therein is added over 10 minutes under slowly mixing. After being substituted with nitrogen, the content of the flask is heated to 70° C. over an oil bath under stirring to continue emulsion polymerization for 5 hours. As a result, an amorphous styrene-acrylate polymer dispersion liquid (SR1) (having a resin particle concentration of 40% by weight) having dispersed therein resin particle having a volume average particle diameter of 100 nm, a glass transition point of 59° C. and a weight average molecular weight (Mw) of 15,000 is prepared.

(Preparation of Crystalline Polyester Resin Dispersion Liquid (BC1) as Binder Resin Component of Core Toner)

An acid component including 90.5% by mole of 1,10-dodecanedioic acid, 2% by mole of dimethyl isophthalate-5-sodium sulfonate and 7.5% by mole of 5-tert-butyl isophthalate, a diol component including 100% by mole of 1,9-nonanediol, and $Ti(OBu)_4$ as a catalyst (in an amount of 0.014% by weight based on the acid component) are placed in a three-neck flask having been dried under heat. The air inside the flask is depressurized, and the interior of the flask is made into an inert atmosphere with nitrogen. The content of the flask is refluxed at 180° C. for 6 hours under mechanically stirring. Thereafter, the excessive amount of ethylene glycol is removed by distillation under reduced pressure. The temperature of the content of the flask is gradually increased to 220° C. and stirred for 4 hours, and when the content reaches a viscous state, the molecular weight thereof is measured with GPC. At the time when the weight average molecular weight reaches 25,000, distillation under reduced pressure is terminated, and the content of the flask is cooled to obtain a crystalline polyester resin (C1).

80 parts by weight of the crystalline polyester resin (C1) and 700 parts by weight of water are placed in a stainless steel beaker, which is heated to 95° C. over a hot water bath. After dissolving the crystalline polyester resin, the solution is agitated by using a homogenizer (Ultra-Turrax T50, produced by IKA Works Inc.) at 8,000 rpm. 20 parts by weight of an aqueous solution obtained by diluting 1.6 parts by weight of an anionic surfactant (Neogen RK, produced by Daiichi Kogyo Seiyaku Co., Ltd.) is added dropwise thereto to effect emulsion dispersion, so as to prepare a crystalline polyester resin dispersion liquid (BC1) having a volume average particle diameter of 0.15 μm (resin particle concentration: 10% by weight).

(Preparation of Amorphous Polyester Resin Dispersion Liquid (BA1) as Binder Resin Component of Core Toner)

113.5 parts by weight of an ethylene oxide adduct of bisphenol A, 260.5 parts by weight of a propylene oxide adduct of bisphenol A, 5 parts by weight of ethylene glycol, 161 parts by weight of dimethyl terephthalate, 47 parts by weight of dodecenylsuccinic acid, 3 parts by weight of triethyl trimellitate and 3 parts by weight of dibutyltin oxide are placed in a reaction vessel equipped with a stirrer, a thermometer, a condenser and a nitrogen introducing pipe, and the interior of the reaction vessel is sufficiently replaced with dried nitrogen. The mixture in the flask is then reacted in a nitrogen gas stream at about 200° C. for about 4 hours under stirring, and the temperature thereof is increased to about 240° C., followed by continuing the reaction about for 5 hours, so as to obtain an amorphous PES resin A1 having a glass transition temperature of 65° C. and a weight average molecular weight (Mw) of 15,000.

(Preparation of Dispersion Liquid)

200 parts by weight of the amorphous PES resin A1 and 700 parts by weight of ion exchanged water are mixed and adjusted to have pH of 8 with aqueous ammonia. The components are mixed at 140° C. by using a dispersing apparatus obtained by modifying an emulsifying apparatus, Cavitron CD1010, produced by Eurotech Inc. to a high temperature and high pressure type, so as to prepare an amorphous resin dispersion liquid BA1 having a solid concentration of 10% and a center diameter of particles in the resin dispersion liquid of 0.7 μm (resin particle concentration: 20% by weight).

Accordingly, such an amorphous polyester resin dispersion liquid is prepared that has dispersed therein resin particles having a glass transition point of 60° C. and a weight average molecular weight (Mw) of 15,000.

(Preparation of Amorphous Polyester Resin Dispersion Liquid (BA2) as Binder Resin Component of Core Toner)

107.5 parts by weight of an ethylene oxide adduct of bisphenol A, 247.5 parts by weight of a propylene oxide adduct of bisphenol A, 5.0 parts by weight of butanediol, 5 parts by weight of ethylene glycol, 161 parts by weight of dimethyl terephthalate, 47 parts by weight of dodecenylsuccinic acid, 3 parts by weight of triethyl trimellitate and 3 parts by weight of dibutyltin oxide are placed in a reaction vessel equipped with a stirrer, a thermometer, a condenser and a nitrogen introducing pipe, and the interior of the reaction vessel is sufficiently replaced with dried nitrogen. The mixture in the flask is then reacted in a nitrogen gas stream at about 200° C. for about 5 hours under stirring, and the temperature thereof is increased to about 240° C., followed by continuing the reaction about for 4 hours, so as to obtain an amorphous PES resin A2 having a glass transition temperature of 65° C. and a weight average molecular weight (Mw) of 15,000.

(Preparation of Dispersion Liquid)

200 parts by weight of the amorphous PES resin A2 and 700 parts by weight of ion exchanged water are mixed and adjusted to have pH of 8 with aqueous ammonia. The components are mixed at 140° C. by using a dispersing apparatus obtained by modifying an emulsifying apparatus, Cavitron CD1010, produced by Eurotech Inc. to a high temperature and high pressure type, so as to prepare an amorphous resin dispersion liquid BA2 having a solid concentration of 10% and a center diameter of particles in the resin dispersion liquid of 0.7 μm (resin particle concentration: 20% by weight).

(Preparation of Releasing Agent Dispersion Liquid)

| | |
|---|---|
| Paraffin wax (HNP9, produced by Nippon Seiro Co., Ltd., melting point: 77° C.) | 50 parts by weight |
| Anionic surfactant (Neogen RK, produced by Daiichi Kogyo Seiyaku Co., Ltd.) | 5 parts by weight |
| Ion exchanged water | 195 parts by weight |

The aforementioned components are heated to 110° C. and dispersed with a homogenizer (Ultra-Turrax T50, produced by IKA Works Inc.), and the resulting dispersion is further dispersed with Manton Gorin High-pressure Homogeneizer (produced by Gorin Inc.) to prepare a releasing agent dispersion liquid having dispersed therein a releasing agent having a volume average particle diameter of 210 nm (releasing agent concentration: 25% by weight).

(Preparation of Colorant Dispersion Liquid)

| | |
|---|---|
| Cyan pigment (C.I. Pigment Blue 15:3 (copper phthalocyanine), produced by Dainichiseika Colour & Chemicals Mfg. Co., Ltd.) | 1,000 parts by weight |
| Anionic surfactant (Neogen R, produced by Daiichi Kogyo Seiyaku Co., Ltd.) | 150 parts by weight |
| Ion exchanged water | 9,000 parts by weight |

The aforementioned components are mixed and dissolved, and the mixture is dispersed by using a high pressure impact dispersing apparatus, Altimizer Model HJP30006 (produced by Sugino Machinery Industries, Ltd.) for about 1 hour, so as to prepare a colorant dispersion liquid having dispersed therein a colorant (cyan pigment). The colorant (cyan pigment) in the colorant dispersion liquid has a volume average particle diameter of 0.15 μm and a colorant particle concentration of 23% by weight.

(Preparation of Crystalline Resin Core Toner as Toner Mother Particles (1))

| | |
|---|---|
| Crystalline polyester resin particle dispersion liquid (BC1) | 2,380 parts by weight |
| Colorant dispersion liquid | 60.9 parts by weight |
| Releasing agent dispersion liquid | 210 parts by weight |

2,380 parts by weight of the crystalline polyester resin particle dispersion liquid (BC1), 60.9 parts by weight of the colorant dispersion liquid, 210 parts by weight of the releasing agent dispersion liquid, 0.5 part by weight of polyaluminum chloride (produced by Wako Pure Chemical Industries, Ltd.) and 100 parts by weight of ion exchanged water are placed in a round-bottom stainless steel flask, and the mixture is adjusted to have pH of 4.0 and then dispersed with a homogenizer (Ultra-Turrax T50, produced by IKA Works Inc.), followed by heating under stirring to 65° C. over a heating oil bath. After maintaining the mixture in the flask at 65° C. for 3 hours, observation with an optical microscope confirms that aggregated particles having a volume average particle diameter of about 5.0 μm are formed. The mixture is further maintained at 65° C. for 1 hour under heating and stirring, and then observation with an optical microscope confirms that aggregated particles having a volume average particle diameter of about 5.5 μm are formed.

The resulting aggregated particle dispersion liquid has pH of 3.8. An aqueous solution obtained by dissolving sodium carbonate (produced by Wako Pure Chemical Industries, Ltd.) to 0.5% by weight is gradually added thereto to adjust the pH to 5.0. The aggregated particle dispersion liquid is heated to 80° C. and maintained at that temperature for 30 minutes under continuous stirring, and then observation with an optical microscope confirms that integrated spherical particles are obtained. The resulting particles are solidified by cooling to 30° C. at a rate of 10° C. per minute by adding ion exchanged water.

Thereafter, the reaction product is filtered and washed with 2,000 parts of ion exchanged water, and the product is again filtered to obtain 560 parts by weight of a toner cake of toner mother particles (1) having a solid concentration of 50% by weight.

(Preparation of Crystalline Resin Core Toner as Toner Mother Particles (2))

Toner mother particles (2) are produced in the same manner as in the preparation of the toner mother particles (1) except that in the preparation of the aggregated particle dispersion liquid, the following components are used instead of the crystalline polyester resin particle dispersion liquid (BC1) and ion exchanged water.

| | |
|---|---|
| Crystalline polyester resin particle dispersion liquid (BC1) | 714 parts by weight |
| Amorphous polyester resin dispersion liquid (BA1) | 833 parts by weight |
| Ion exchanged water | 700 parts by weight |

(Preparation of Crystalline Resin Core Toner as Toner Mother Particles (3))

Toner mother particles (3) are produced in the same manner as in the preparation of the toner mother particles (1) except that in the preparation of the aggregated particle dispersion liquid, the following components are used instead of the crystalline polyester resin particle dispersion liquid (BC1) and ion exchanged water.

| | |
|---|---|
| Amorphous polyester resin dispersion liquid (BA2) | 1,190 parts by weight |
| Ion exchanged water | 1,000 parts by weight |

(Production Method of Core-shell Toner (Toner of Example 1))

560 parts by weight of the toner cake of the toner mother particles (1) having a solid concentration of 50% by weight is placed in a 3-L flask, to which 52.2 parts by weight of the crosslinked particle dispersion liquid (F1) and 16.8 parts by weight of the amorphous polymer dispersion liquid (SR1) are then added thereto, and stirring is started. After lapsing 10 minutes, ion exchanged water is added thereto in such an amount that provides a solid concentration of 35%, and the pH is adjusted to 3.0 by adding slowly a nitric acid aqueous solution having a concentration of 0.3 mole/L. After lapsing 30 minutes, 0.11 part by weight (0.5% by weight of the solid content of the shell) of polyaluminum chloride is added, and after further lapsing 30 minutes, the temperature is increased to 48° C. at a rate of 0.5° C. per minute. After maintaining at 48° C. for 2 hours, the temperature is increased to 57° C. at a rate of 0.1° C. per minute. The pH at this time is 7.3, and thus a sodium hydroxide aqueous solution having a concentration of 0.5 mole/L is gradually added thereto to adjust the pH to 7.5, followed by continuously heating for 10 hours. After lapsing 10 hours, observation with a scanning electron microscope (SEM) confirms that a coated layer of the attached particles is formed on the surface of the core particles, and then the mixture is cooled to 20° C. over 30 minutes.

After cooling, measurement with a Coulter Counter Model TA-II (aperture diameter: 50 μm, produced by Beckman Coulter, Inc.) reveals that the volume average particle diameter is 5.5 μm.

Thereafter, the reaction product is filtered, sufficiently washed with ion exchanged water, and then dried with a vacuum dryer, so as to obtain a toner for developing an electrostatic image (1).

The resulting toner for developing an electrostatic image (1) is measured with a Coulter Counter Model TA-II (aperture diameter: 50 μm, produced by Beckman Coulter, Inc.), and it is found that the toner has a volume average particle diameter of 5.5 μm and a number average particle diameter of 4.6 μm. Observation of the particles with an optical microscope reveals that the particles have a spherical shape.

The shape factor SF1 of the toner means a value calculated by the following equation, and SF1 is 100 when the particle is a true sphere. The specific operation for obtaining the shape fact is as follows. A toner scattered on a slide glass is observed with an optical microscope. The resulting optical micrograph is incorporated into a Luzex image analyzer through a video camera, and the value of SF1 is obtained for 50 particles according to the following equation. An average value of the resulting values is obtained.

$$SF1 = \frac{(ML)^2}{A} \times \frac{\pi}{4} \times 100$$

wherein ML represents the maximum length of the toner particle, and A represents the projected area of the toner particle.

The measurement of the BET specific surface area is carried out by the nitrogen substitution method. Specifically, it is measured by the three-point method using a specific surface area measuring apparatus, SA3100, produced by Beckman Coulter, Inc.

The toner (1) has a shape factor SF1 of 121 obtained by shape observation with the Luzex image analyzer. The toner (1) has a BET specific surface area of 1.41 $m^2/g$.

(Production Method of Core-shell Toner (Toners of Examples 2 to 8 and 11 and Comparative Examples 1 to 3))

Toners of Examples 2 to 8 and 11 and Comparative Examples 1 to 3 are produced in the same manner as the core-shell toner of Example 1 according to the formulations shown in Table 1 below.

(Production Method of Toners of Comparative Examples 4 to 6)

The crystalline resin core toner as the toner mother particles (1) is used as a toner of Comparative Example 4 without forming a shell.

The core toners of Examples 8 and 11 are used as toners of Comparative Examples 5 and 6, respectively, without forming a shell.

(Production Method of Toner of Reference Example)

A toner of Reference Example is produced in the same manner as the toner mother particles (1) except that the amorphous styrene-acrylate polymer dispersion liquid (SR1) is used instead of the crystalline polyester resin particle dispersion liquid (BC1). The resulting toner is used without forming a shell.

(Production Method of Toners of Examples 9 and 10)

Preparation of Crystalline Resin Core Toner as Toner Mother Particles (4)

| | |
|---|---|
| Crystalline polyester resin particle dispersion liquid (BC1) | 714 parts by weight |
| Amorphous polyester resin dispersion liquid (BA1) | 833 parts by weight |
| Colorant dispersion liquid | 44.2 parts by weight |
| Releasing agent dispersion liquid | 112 parts by weight |

The aforementioned components and 200 parts by weight of ion exchanged water are placed in a round-bottom stainless steel flask, and the mixture is adjusted to have pH of 4.0 and then dispersed with a homogenizer (Ultra-Turrax T50, produced by IKA Works Inc.). 5 parts by weight of polyaluminum chloride is added thereto, and the mixture is heated under stirring to 48° C. over a heating oil bath. After maintaining the mixture in the flask at 48° C. for 3 hours, observation with an optical microscope confirms that aggregated particles having a volume average particle diameter of about 5.0 μm as a core component are formed. 104.5 parts by weight of the crosslinked particle dispersion liquid (F1) and 33.6 parts by weight of the thermoplastic resin dispersion liquid (SR1) are gradually added thereto, and after maintaining the mixture under heating and stirring at 48° C. for 1 hour, observation with an optical microscope confirms that aggregated particles having a volume average particle diameter of about 5.5 μm (measured with a particle size measuring apparatus) are formed. Thereafter, the system is adjusted to have pH of 9.5 with a sodium hydroxide solution and then heated to 95° C. at a temperature increasing rate of 1° C. per minute, followed by maintaining the system for 1 hour, and then the system is cooled to obtain a toner of Example 9. Observation with an optical microscope confirms that aggregated particles having a volume average particle diameter of about 5.5 μm (measured with a particle size measuring apparatus) are formed. It is also confirmed by cross sectional observation of the particles with a transmission electron microscope that the particles constitute a toner having a core-shell structure.

A toner of Example 10 is produced in the same manner as the toner of Example 9 except that the formulation shown in Table 1 is used.

The aforementioned toners are maintained under conditions of 48° C. and pH 9.0 for 1 hour, and then washed with 2,000 parts by weight of ion exchanged water, followed by drying in a freeze dryer, so as to obtain toners in the form of powder.

TABLE 1

| | | Core toner | | | | Shell | | | | |
|---|---|---|---|---|---|---|---|---|---|---|
| | | Binder resin | | | | | Filler | | Thermoplastic resin | |
| | | Crystalline resin BC1 (part by weight) | Amorphous resin (part by weight) | Wax | Pigment | Shell amount (in total) | Kind of filler | Amount of filler (part by weight) | Thermoplastic resin | Amount of thermo-plastic resin (part by weight) |
| Ex. 1 | Toner 1 | 85 | none | 10 | 5 | 8 | crosslinked | 5.6 | Thermo- | 2.4 |
| Ex. 2 | Toner 2 | | | parts | parts | 16 | particles | 11.2 | plastic | 4.8 |
| Ex. 3 | Toner 3 | | | by | by | 30 | F1 | 21 | resin SR1 | 9 |
| Ex. 4 | Toner 4 | | | weight | weight | 50 | | 35 | | 15 |
| Ex. 5 | Toner 5 | | | | | 16 | | 14.4 | | 1.6 |
| Ex. 6 | Toner 6 | | | | | 16 | | 4.8 | | 11.2 |
| Ex. 7 | Toner 7 | | | | | 8 | silica particles F2 | 2.4 | | 5.6 |
| Ex. 8 | Toner 8 | 25.5 | resin A1 | | | 8 | crosslinked | 5.6 | | 2.4 |
| Ex. 9 | Toner 9 | | 59.5 | | | 16 | particles | 11.2 | | 4.8 |
| Ex. 10 | Toner 10 | | | | | 30 | F1 | 21 | | 9 |
| Ex. 11 | Toner 11 | none | resin A2 low Tg 85 | | | 16 | | 11.2 | | 4.8 |
| C. Ex. 1 | Toner 12 | 85 | none | 10 | 5 | 8 | none | none | Thermo-plastic | 8 |
| C. Ex. 2 | Toner 13 | 25.5 | resin A1 59.5 | parts by | parts by | 8 | none | none | resin SR1 | 8 |
| C. Ex. 3 | Toner 14 | none | resin A2 low Tg 85 | weight | weight | 16 | none | none | | 16 |
| C. Ex. 4 | Toner 15 | 85 | none | | | none | none | none | none | none |
| C. Ex. 5 | Toner 16 | 25.5 | resin A1 59.5 | | | none | none | none | none | none |
| C. Ex. 6 | Toner 17 | none | resin A2 low Tg 85 | | | none | none | none | none | none |
| Ref. Ex. | Toner 18 | none | Thermo-plastic resin SR1 | | | none | none | none | none | none |

(Measuring Method)

(Evaluation Method for Characteristics of Toner)

(1) Measurement of Flow Tester ½ Effluent Temperature

The flow tester ½ effluent temperature is measured by using a flow tester, CFT500, produced by Shimadzu Corp., with a die diameter of 0.5 mm, a die length of 0.5 mm, a pressure of 10 kgf and a temperature increasing rate of 3° C. per minute.

(2) Particle Size Distribution

The particle size distribution of the toner is measured in such manner that an accumulated distribution of diameter is drawn from the small diameter side for the divided particle size ranges (channels) with respect to volume and number, respectively, and a volume average particle diameter and a number average particle diameter are obtained. The particle diameter at an accumulation of 16% by volume is designated as a D16% volume average particle diameter, the particle diameter at an accumulation of 50% by volume is designated as a D50% volume average particle diameter, and particle diameter at an accumulation of 84% by volume is designated as a D84% volume average particle diameter.

The particle size distribution of the toner is obtained by measuring the volume particle size with a Coulter Counter Model TA-II (aperture diameter: 50 μm, produced by Beckman Coulter, Inc.) and calculated according to the following equation.

$$\text{Particle size distribution}=((D50\%\ \text{diameter}/D84\%\ \text{diameter})+(D16\%\ \text{diameter}/D50\%\ \text{diameter}))/2$$

The D50% volume particle diameter of the toner is designated as the particle diameter of the toner. The particle diameter at an accumulation of 50% by number is designated as the number average particle diameter of the toner.

(3) Particle Diameter

The volume average particle diameter and the number average particle diameter of the toner are measured with a Coulter Counter Model TA-II (aperture diameter: 50 μm, produced by Beckman Coulter, Inc.).

(Preparation of Toner for Developing Electrostatic Image)

2.5 parts by weight of spherical silica (average primary diameter: 140 nm, sol-gel method, treated with hexamethylsilazane, sphericity: 0.90) as an external additive is added to 100 parts by weight of the toner, and the mixture is dispersed in a 20-L Henschel mixer at a peripheral velocity of 40 m/s for 10 minutes. Thereafter, 1.2 parts by weight of rutile type titanium oxide (primary diameter: 20 nm, treated with n-decyltrimethoxysilane) is added, and the mixture is dispersed at a peripheral velocity of 40 m/s for 5 minutes. Coarse particles are then removed from the mixture by using a sieve having a mesh of 45 μm to obtain a toner for developing an electrostatic image.

(Evaluation of Fixing Property by Lowest Fixing Temperature)

5 parts by weight of the toner and 100 parts by weight of resin-coated ferrite particles (volume average particle diameter: 35 μm) are mixed to prepare a two-component developer.

A non-fixed image is formed by using an electrophotographic duplicator (Docu Centre Color 500, produced by Fuji Xerox Co., Ltd.) using the developer on paper (C2 Paper, produced by Fuji Xerox Co., Ltd., basis weight: 15 g/m$^2$).

The fixing property and the hot offset property of the image are evaluated by using an external fixing device (a free belt nip fuser of Docu Centre Color 400) at a fixing temperature increasing stepwise within a range of from 70 to 220° C. The low temperature fixing property is evaluated in such a manner that after fixing a non-fixed solid image (25 mm×25 mm), the image is folded by using a prescribed weight, and the temperature, at which the dropout width of the image at the folded part becomes 0.5 mm, is designated as the lowest fixing temperature, which is used as an index of the low temperature fixing property.

(Thermal Storage Stability of Toner)

2 g of the toner is weighed on a classification sieve of 53 μm having a diameter of about 10 cm, and an upper cover is placed thereon for preventing the toner from being scattered. After allowing to stand the toner under conditions of a temperature of 55° C. and a humidity of 50% for 24 hours, the toner is vibrated for about 90 seconds with a powder tester, produced by Hosokawa Micron Corp., and the amount of the toner remaining on the sieve is measured. In the case where the amount of the toner remaining on the sieve of 53 μm is 0.5 g or more, the toner is decided as to be insufficient in thermal storage stability (C). In the case where the remaining amount of the toner is 0.2 g or more and less than 0.5 g, the toner is decided as to be usable (B). In the case where the remaining amount of the toner is less than 0.2 g, the toner is decided as to be excellent in storage stability (A).

(Filming)

10,000 sheets are continuously printed by using Docu Centre Color 500, produced by Fuji Xerox Co., Ltd., which can print color images on 16 sheets of A4 size paper per minute, and then the presence of filming of the toner on the latent image carrying member and the presence of image defects are observed.

The evaluation results of the toners of Examples 1 to 11, Comparative Examples 1 to 6 and Reference Example are shown in Table 2 below.

TABLE 2

| | | | | Evaluation of capabilities | | |
|---|---|---|---|---|---|---|
| Description | | Volume average particle diameter of toner (μm) | Evaluation of characteristics Flow tester ½ effluent temperature | Lowest fixing temperature | Aggregation degree at 55° C. (thermal storage stability) | Filming |
| core/shell ratio | Ex. 1 | 5.7 | 80° C. | 100° C. | A | none |
| core/shell ratio | Ex. 2 | 5.8 | 83° C. | 105° C. | A | none |
| core/shell ratio | Ex. 3 | 5.9 | 86° C. | 110° C. | A | none |
| core/shell ratio | Ex. 4 | 6.0 | 88° C. | 120° C. | A | none |
| filler amount | Ex. 5 | 5.6 | 86° C. | 105° C. | A | none |
| filler amount | Ex. 6 | 5.6 | 84° C. | 105° C. | B | none |
| filler amount | Ex. 7 | 5.6 | 88° C. | 100° C. | A | none |
| kind of core | Ex. 8 | 6.0 | 90° C. | 105° C. | B | none |
| kind of core | Ex. 9 | 5.5 | 94° C. | 110° C. | A | none |
| kind of core | Ex. 10 | 6.2 | 95° C. | 120° C. | A | none |
| kind of core | Ex. 11 | 5.9 | 100° C. | 115° C. | B | none |
| no particle | C. Ex. 1 | 5.6 | 85° C. | 105° C. | C | occurred |
| no particle | C. Ex. 2 | 6.1 | 93° C. | 110° C. | C | occurred |
| no particle | C. Ex. 3 | 5.9 | 100° C. | 115° C. | C | occurred |
| no shell | C. Ex. 4 | 5.5 | 75° C. | 90° C. | C | occurred |
| no shell | C. Ex. 5 | 6.0 | 90° C. | 102° C. | C | occurred |
| no shell | C. Ex. 6 | 5.8 | 95° C. | 100° C. | C | occurred |
| no shell and toner with ordinary Tg | Ref. Ex. | 5.7 | 125° C. | 140° C. | B | none |

(Evaluation Result of Capabilities of Toner)

Table 2 shows the evaluation results of the lowest fixing temperature, the storage stability at 55° C. and the filming. The toners of Examples have a low fixing temperature and good thermal storage stability, and can suppress filming on the latent image carrying member from occurring. No image defect is formed due to filming.

The toners of Comparative Examples 1 to 3 contain no filler in the shell layer, and are inferior in thermal storage stability and filming. They cannot be used practically since filming occurs on the latent image carrying member, and image defects are formed. The toner of Reference Example has a ½ effluent temperature of 125° C. and a glass transition temperature of 65° C., which are in the ordinary ranges, and it is excellent in thermal storage stability and anti-filming property but cannot attain low temperature fixing.

| (Production Example of Silica Aqueous Dispersion Liquid (F3) as Filler Component) | |
|---|---|
| R805 (surface hydrophobic silica, produced by Nippon Aerosil Co., Ltd., diameter: 16 nm) | 100 parts by weight |
| Anionic surfactant (Neogen RK, produced by Daiichi Kogyo Seiyaku Co., Ltd.) | 5 parts by weight |
| Ion exchanged water | 895 parts by weight |

The aforementioned anionic surfactant is added to 895 parts by weight of ion exchanged water, and then the silica particles are gradually added to the resulting aqueous solution to obtain a silica dispersion liquid (F3).

(Preparation of Crystalline Resin Core Toner as Toner Mother Particles (5))

| | |
|---|---|
| Crystalline polyester resin particle dispersion liquid (BC1) | 2,142 parts by weight |
| Crosslinked particle dispersion liquid (F1) | 79.3 parts by weight |
| Colorant dispersion liquid | 44.2 parts by weight |
| Releasing agent dispersion liquid | 112 parts by weight |

2,142 parts by weight of the crystalline polyester resin particle dispersion liquid (BC1), 79.3 parts by weight of the colorant dispersion liquid, 112 parts by weight of the releasing agent dispersion liquid, 0.5 part by weight of polyaluminum chloride (produced by Wako Pure Chemical Industries, Ltd.) and 100 parts by weight of ion exchanged water a replaced in a round-bottom stainless steel flask, and the mixture is adjusted to have pH of 4.0 and then dispersed with a homogenizer (Ultra-Turrax T50, produced by IKA Works Inc.), followed by heating under stirring to 65° C. over a heating oil bath. After maintaining the mixture in the flask at 65° C. for 3 hours, observation with an optical microscope confirms that aggregated particles having a volume average particle diameter of about 5.0 μm are formed. The mixture is further maintained at 65° C. for 1 hour under heating and stirring, and then observation with an optical microscope confirms that aggregated particles having a volume average particle diameter of about 5.5 μm are formed.

The resulting aggregated particle dispersion liquid has pH of 3.8. An aqueous solution obtained by dissolving sodium carbonate (produced by Wako Pure Chemical Industries, Ltd.) to 0.5% by weight is gradually added thereto to adjust the pH to 5.0. The aggregated particle dispersion liquid is heated to 80° C. and maintained at that temperature for 30 minutes under continuous stirring, and then observation with an optical microscope confirms that integrated spherical particles are obtained. The resulting particles are solidified by cooling to 30° C. at a rate of 10° C. per minute by adding ion exchanged water.

Thereafter, the reaction product is filtered and washed with 2,000 parts of ion exchanged water, and the product is again filtered to obtain 560 parts by weight of a toner cake of toner mother particles of Example 12 having a solid concentration of 50% by weight.

(Preparation of Core Toners of Examples 13, 14, 16 and 17 and Comparative Examples 7 to 9)

The toners of Examples 13, 14, 16 and 17 and Comparative Examples 7 to 9 are prepared in the same manner as the core toner of Example 12 according to the formulations shown in Table 3 below.

(Preparation of Core Toner of Example 15)

A toner of Example 15 is prepared in the following manner. The materials shown in Table 3 are blended by the melt kneading method, and the mixture is pulverized and classified to obtain a toner having a diameter of 5.8 μm. 100 parts by weight of the resulting toner is dispersed in a solution obtained by mixing 3 parts by weight of a surfactant, Neogen RK, and 897 parts by weight of ion exchanged water, and the resulting dispersion liquid is filtered to obtain 560 parts by weight of a toner cake of toner mother particles of Example 15 having a solid concentration of 50% by weight.

(Production Method of Core-shell Toner (Toner of Example 12))

560 parts by weight of the toner cake of the toner mother particles (5) having a solid concentration of 50% by weight is placed in a 3-L flask, to which 112 parts by weight of the amorphous polymer dispersion liquid (SR1) is then added thereto, and stirring is started. After lapsing 10 minutes, ion exchanged water is added thereto in such an amount that provides a solid concentration of 35%, and the pH is adjusted to 3.0 by adding slowly a nitric acid aqueous solution having a concentration of 0.3 mole/L. After lapsing 30 minutes, 0.11 part by weight (0.5% by weight of the solid content of the shell) of polyaluminum chloride is added, and after further lapsing 30 minutes, the temperature is increased to 48° C. at a rate of 0.5° C. per minute. After maintaining at 48° C. for 2 hours, the temperature is increased to 57° C. at a rate of 0.1° C. per minute. The pH at this time is 7.3, and thus a sodium hydroxide aqueous solution having a concentration of 0.5 mole/L is gradually added thereto to adjust the pH to 7.5, followed by continuously heating for 10 hours. After lapsing 10 hours, observation with a scanning electron microscope (SEM) confirms that a coated layer of the attached particles is formed on the surface of the core particles, and then the mixture is cooled to 20° C. over 30 minutes.

After cooling, measurement with a Coulter Counter Model TA-II (aperture diameter: 50 μm, produced by Beckman Coulter, Inc.) reveals that the volume average particle diameter is 5.7 μm.

Thereafter, the reaction product is filtered, sufficiently washed with ion exchanged water, and then dried with a vacuum dryer, so as to obtain a toner for developing an electrostatic image (19).

The resulting toner for developing an electrostatic image (19) is measured with a Coulter Counter Model TA-II (aperture diameter: 50 μm, produced by Beckman Coulter, Inc.), and it is found that the toner has a volume average particle diameter of 5.5 μm and a number average particle diameter of 4.6 μm. Observation of the particles with an optical microscope reveals that the particles have a spherical shape.

The toner (19) has a shape factor SF1 of 121 obtained by shape observation with the Luzex image analyzer. The toner (19) has a BET specific surface area of 1.41 $m^2/g$.

(Production Method of Core-shell Toner (Toners of Examples 13 to 18 and Comparative Examples 7 to 9))

Toners of Examples 13 to 17 and Comparative Examples 7 to 9 are produced in the same manner as the core-shell toner of Example 12 according to the formulations shown in Table 3 below.

(Production Method of Toners of Comparative Examples 10 to 12)

The crystalline resin core toner as the toner mother particles (5) is used as a toner of Comparative Example 10 without forming a shell.

The core toners of Examples 16 and 17 are used as toners of Comparative Examples 11 and 12, respectively, without forming a shell.

The aforementioned toners are maintained under conditions of 48° C. and pH 9.0 for 1 hour, and then washed with 2,000 parts by weight of ion exchanged water, followed by drying in a freeze dryer, so as to obtain toners in the form of powder.

TABLE 3

| | | Core toner | | | | | | Shell Thermoplastic resin | |
|---|---|---|---|---|---|---|---|---|---|
| | | Binder resin | | | Amount | | | | Amount of |
| | | Crystalline resin BC1 (part by weight) | Amorphous resin (part by weight) | Kind of filler | of filler (part by weight) | Wax | Pigment | Thermo-plastic resin | thermo-plastic resin (part by weight) |
| Ex. 12 | Toner 19 | 76.5 | none | Crosslinked particles F1 | 8.5 | 10 parts by weight | 5 parts by weight | Thermo-plastic resin SR1 | 16 |
| Ex. 13 | Toner 20 | 68 | | Crosslinked particles F1 | 17 | | | | 16 |
| Ex. 14 | Toner 21 | 76.5 | | Silica particles F3 | 8.5 | | | | 16 |
| Ex. 15 | Toner 22 | 68 | | Silica particles F3 | 17 | | | | 16 |
| Ex. 16 | Toner 23 | 22.95 | resin A1 53.55 | Crosslinked particles F1 | 8.5 | | | | 16 |
| Ex. 17 | Toner 24 | none | resin A2 low Tg 76.5 | Silica particles F3 | 8.5 | | | | 16 |
| C. Ex. 7 | Toner 25 | 85 | none | none | 0 | 10 parts by weight | 5 parts by weight | Thermo-plastics resign SR1 | 16 |
| C. Ex. 8 | Toner 26 | 25.5 | resin A1 59.5 | none | 0 | | | | 16 |
| C. Ex. 9 | Toner 27 | none | resin A2 low Tg 85 | none | 0 | | | | 16 |
| C. Ex. 10 | Toner 28 | 76.5 | none | Crosslinked particles F1 | 8.5 | | | none | none |
| C. Ex. 11 | Toner 29 | 22.95 | resin A1 53.55 | Crosslinked particles F1 | 8.5 | | | none | none |
| C. Ex. 12 | Toner 30 | none | resin A2 low Tg 76.5 | Silica particles F3 | 8.5 | | | none | none |
| Ref.Ex. | Toner 18 | none | Thermo plastic resin SR1 | none | 0 | | | none | none |

Toners for developing an electrostatic image are prepared by using the toners of Examples 12 to 17, Comparative Examples 7 to 12 and Reference Example in the same manner as above. The resulting toners for developing an electrostatic image are evaluated for fixing property, thermal storage stability and filming in the same manner as above. The evaluation results are shown in Table 4 below.

TABLE 4

| | | | | Evaluation of capabilities | | |
|---|---|---|---|---|---|---|
| Description | | Volume average particle diameter of toner (μm) | Evaluation of characteristics Flow tester ½ effluent temperature | Lowest fixing temperature | Aggregation degree at 55° C. (thermal storage stability) | Filming |
| filler amount | Ex. 12 | 5.7 | 80° C. | 100° C. | B | none |
| filler amount | Ex. 13 | 5.8 | 83° C. | 105° C. | A | none |
| filler amount | Ex. 14 | 5.9 | 86° C. | 105° C. | A | none |
| melt kneading method | Ex. 15 | 5.8 | 88° C. | 110° C. | A | none |
| kind of core | Ex. 16 | 6.0 | 90° C. | 105° C. | B | none |
| kind of core | Ex. 17 | 5.9 | 100° C. | 115° C. | B | none |
| no filler | C. Ex. 7 | 5.6 | 85° C. | 105° C. | C | occurred |
| no filler | C. Ex. 8 | 6.1 | 93° C. | 110° C. | C | occurred |
| no filler | C. Ex. 9 | 5.9 | 100° C. | 115° C. | C | occurred |
| no shell | C. Ex. 10 | 5.5 | 75° C. | 90° C. | C | occurred |
| no shell | C. Ex. 11 | 6.0 | 90° C. | 95° C. | C | occurred |
| no shell | C. Ex. 12 | 5.8 | 95° C. | 100° C. | C | occurred |
| no shell and toner with ordinary Tg | Ref.Ex. | 5.7 | 125° C. | 140° C. | B | none |

(Evaluation Result of Capabilities of Toner)

Table 4 shows the evaluation results of the lowest fixing temperature, the storage stability at 55° C. and the filming. The toners of Examples have a low fixing temperature and good thermal storage stability, and can suppress filming on the latent image carrying member from occurring. No image defect is formed due to filming.

The toners of Comparative Examples 7 to 9 contain no filler in the core, and are inferior in thermal storage stability and filming. They cannot be used practically since filming occurs on the latent image carrying member, and image defects are formed. The toner of Reference Example has a ½ effluent temperature of 125° C. and a glass transition temperature of 65° C., which are in the ordinary ranges, and it is excellent in thermal storage stability and anti-filming property but cannot attain low temperature fixing.

(Preparation of Toner of Example 18)

Core toner of Example 18 is produced in the same manner as the core toner of Example 12 according to the formulations shown in Table 5 below. Subsequently, a shell layer is formed on the resulting core toner according to the formulation shown in Table 5 in the same manner as in the core-shell toner of Example 1, so as to obtain a toner of Example 18.

Toner for developing an electrostatic image is prepared by using the toner of Example 18 in the same manner as above. The resulting toner for developing an electrostatic image is evaluated for fixing property, thermal storage stability and filming in the same manner as above. The evaluation results are shown in Table 6 below.

(Evaluation Result of Capabilities of Toner)

Table 6 shows the evaluation results of the lowest fixing temperature, the storage stability at 55° C. and the filming. The toner of Example 18 containing the filler in both the core and the shell has a low fixing temperature and good thermal storage stability, and can suppress filming on the latent image carrying member from occurring. No image defect is formed due to filming.

According to the invention, such a toner can be obtained that attains low temperature fixing property, is excellent in thermal storage stability of the toner powder and anti-filming property, and provides well balanced electrophotographic toner characteristics. Furthermore, a method for producing the toner, a developer for developing an electrostatic image, and an image forming method using the same can also be obtained.

The entire disclosure of Japanese Patent Application No. 2005-082132 filed on Mar. 22, 2005 including specification, claims, drawings and abstract is incorporated herein by reference in its entirely.

What is claimed is:

1. A toner for developing an electrostatic image, the toner having a core-shell structure, wherein the toner comprises:

a colorant;

a crystalline polyester binder resin selected from the group consisting of poly-1,2-cyclopropenedimethylene isophthalate, polydecamethylene adipate, polydecamethyl-

TABLE 5

| | | Core toner | | | | | |
|---|---|---|---|---|---|---|---|
| | | Binder resin | | | | | |
| | | Crystalline resin BC1 (part by weight) | Amorphous resin (part by weight) | Kind of filler | Amount of filler (part by weight) | Wax (part by weight) | Pigment (part by weight) |
| Ex. 18 | Toner 31 | 25.5 | resin A1 49.5 | Cross-linked particles F1 | 10 | 10 | 5 |

| | | Shell | | | | |
|---|---|---|---|---|---|---|
| | | | Filler | | Thermoplastic resin | |
| | | Amount of shell (total) | Kind of filler | Amount of filler (part by weight) | Thermo-plastic resin | Amount of thermo-plastic resin (part by weight) |
| Ex. 18 | Toner 31 | 16 | Cross-linked particles F1 | 2 | Thermo-plastic resin SR1 | 14 |

TABLE 6

| | | | | Evaluation of capabilities | | |
|---|---|---|---|---|---|---|
| Description | | Volume average particle diameter of toner (μm) | Evaluation of characteristics Flow tester ½ effluent temperature | Lowest fixing temperature | Aggregation degree at 55° C. (thermal storage stability) | Filming |
| filler contained in both core and shell | Ex. 18 | 6.0 | 91° C. | 115° C. | A | none |

ene azelate, polydecamethylene oxalate, polydecamethylene sebacate, polydecamethylene succinate, polyeicosamethylene malonate, polyethylene-p-(carbophenoxy) butyrate, polyethylene-p-(carbophenoxy) undecanoate, polyethylene-p-phenylene diacetate, polyethylene sebacate, polyethylene succinate, polyhexamethylene carbonate, polyhexamethylene-p-(carbophenoxy) undecanoate, polyhexamethylene oxalate, polyhexamethylene sebacate, polyhexamethylene suberate, polyhexamethylene succinate, poly-4,4-isopropylidenediphenylene adipate, poly-4,4-isopropylidenediphenylene malonate, trans-poly-4,4-isopropylidenediphenylene-1-methylcyclopropane dicarboxylate, polynonamethylene azelate, polynonamethylene terephthalate, polyoctamethylene dodecanedioate, polypentamethylene terephthalate, trans-poly-m-phenylenecyclopropane dicarboxylate, cis-poly-m-phenylenecyclopropane dicarboxylate, polytetramethylene carbonate, polytetramethylene-p-phenylene diacetate, polytetramethylene sebacate, polytrimethylene dodecanedioate, polytrimethylene octadecanedioate, polytrimethylene oxalate, polytrimethylene undecanedioate, poly-p-xylene adipate, poly-p-xylene azelate, poly-p-xylene sebacate, polydiethylene glycol terephthalate, cis-poly-1,4-(2-butene) sebacate, polycaprolactone and mixtures thereof; and a silica filler in the core of the toner in an amount from 10% to 40%, wherein the toner has a flow tester ½ effluent temperature of from 60 to 100° C., and a shell of the toner comprises a thermoplastic resin and a filler.

2. A toner for developing an electrostatic image according to claim 1, wherein the silica has an average particle diameter of from 1 to 300 nm.

3. A toner for developing an electrostatic image according to claim 1, wherein the thermoplastic resin in the shell of the toner having a core-shell structure has a glass transition temperature of 55° C. or more.

4. A toner for developing an electrostatic image according to claim 1, wherein the content of the colorant is 1 part by weight or more and is 30 parts by weight or less, per 100 part by weight of the binder resin.

5. A toner for developing an electrostatic image according to claim 1, wherein the toner comprises a releasing agent in an amount of 0.1% to 20% by weight.

6. A toner for developing an electrostatic image according to claim 1, wherein the toner comprises a releasing agent having a melting point of from 40 to 150° C.

7. A toner for developing an electrostatic image according to claim 1, wherein the toner has a volume average particle diameter of from 3 to 20 μm.

8. A developer for developing an electrostatic image, comprising:

the toner for developing an electrostatic image as claimed in claim 1; and a carrier.

9. An image forming method comprising:

forming an electrostatic latent image on a surface of a latent image carrying member;

developing the electrostatic latent image formed on the surface of the latent image carrying member with a developer comprising a toner, to form a toner image;

transferring the toner image formed on the latent image carrying member to a surface of a transferring material; and fixing under heat the toner image transferred to the surface of the transferring material, wherein the toner as claimed in claim 1 is used as the toner.

10. An image forming method comprising:

forming an electrostatic latent image on a surface of a latent image carrying member;

developing the electrostatic latent image formed on the surface of the latent image carrying member with a developer comprising a toner, to form a toner image;

transferring the toner image formed on the latent image carrying member to a surface of a transferring material; and fixing under heat the toner image transferred to the surface of the transferring material, or the developer as claimed in claim 8 is used as the developer.

11. A toner for developing an electrostatic image according to claim 1, wherein an amount of the filler in the shell is 30% by weight or more.

* * * * *